US006385864B1

(12) United States Patent
Sell, Jr. et al.

(10) Patent No.: US 6,385,864 B1
(45) Date of Patent: May 14, 2002

(54) FOOTWEAR BLADDER WITH CONTROLLED FLEX TENSILE MEMBER

(75) Inventors: James C. Sell, Jr., Battle Ground, WA (US); Craig E. Santos, Portland, OR (US); David B. Herridge, Mendota Heights, MN (US); Daniel R. Potter, Forest Grove, OR (US)

(73) Assignee: Nike, Inc., Beaverton, OR (US)

( * ) Notice: Subject to any disclaimer, the term of this patent is extended or adjusted under 35 U.S.C. 154(b) by 0 days.

(21) Appl. No.: 09/526,861

(22) Filed: Mar. 16, 2000

(51) Int. Cl.[7] ..... A43B 13/20
(52) U.S. Cl. ..... 36/29; 36/35 B
(58) Field of Search ..... 36/29, 71, 35 B, 36/153; 428/72, 178, 179, 76

(56) References Cited

U.S. PATENT DOCUMENTS

| | | | |
|---|---|---|---|
| 900,867 | A | 10/1908 | Miller |
| 1,069,001 | A | 7/1913 | Guy |
| 1,240,153 | A | 9/1917 | Olsen |
| 1,304,915 | A | 5/1919 | Spinney |
| 1,323,610 | A | 12/1919 | Price |
| 1,514,468 | A | 11/1924 | Schopf |
| 1,584,034 | A | 5/1926 | Klotz |
| 1,625,582 | A | 4/1927 | Anderson |
| 1,625,810 | A | 4/1927 | Krichbaum |
| 1,869,257 | A | 7/1932 | Hitzler |
| 1,916,483 | A | 7/1933 | Krichbaum |
| 1,970,803 | A | 8/1934 | Johnson |
| 2,004,906 | A | 6/1935 | Simister |
| 2,080,469 | A | 5/1937 | Gilbert |
| 2,086,389 | A | 7/1937 | Pearson |
| 2,269,342 | A | 1/1942 | Johnson |
| 2,365,807 | A | 12/1944 | Dialynas |
| 2,488,382 | A | 11/1949 | Davis |
| 2,546,827 | A | 3/1951 | Lavinthal |
| 2,600,239 | A | 6/1952 | Gilbert |
| 2,645,865 | A | 7/1953 | Town |
| 2,677,906 | A | 5/1954 | Reed |
| 2,703,770 | A | 3/1955 | Melzer |
| 2,748,401 | A | 6/1956 | Winstead |

(List continued on next page.)

FOREIGN PATENT DOCUMENTS

| | | |
|---|---|---|
| AT | 181938 | 2/1906 |
| AT | 200963 | 12/1958 |
| CA | 727582 | 2/1966 |
| DE | 32 34 086 | 9/1982 |
| DE | 92 01 758.4 | 12/1992 |
| EP | 0 094 868 | 5/1983 |

(List continued on next page.)

OTHER PUBLICATIONS

Sports Research Review, Nike, Inc., Jan./Feb. 1990.
Brooks Running Catalog, Fall 1991.

*Primary Examiner*—Ted Kavanaugh
(74) *Attorney, Agent, or Firm*—Banner & Witcoff, Ltd.

(57) ABSTRACT

A bladder for a sole assembly of a shoe with three dimensional controlled flex connecting/tensile members extending between the top and bottom outer layers of bladder. The connecting/tensile members are formed during molding of the bladder and comprise top and bottom portions that come together at a juncture. Since the outer perimeter and the internal connecting/tensile members are formed at the same time and of the same material, bonding problems between layers is eliminated and manufacturing is simplified. The connecting/tensile members are formed with a predetermined flex point in at least a portion of each member to reduce random fatigue stress concentrations. Broadly, there are two configurations: one in which the tensile member is constructed to collapse upon compressive loading, and one in which the tensile member is constructed to bend or fold upon compressive loading in a predetermined location. The shape, relative size, length and barrier material thickness are manipulated to assist in finely tuning the cushioning properties of the final bladder.

21 Claims, 14 Drawing Sheets

U.S. PATENT DOCUMENTS 2,762,134 A 9/1956 Town
3,030,640 A 4/1962 Gosman
3,048,514 A 8/1962 Bentele et al.
3,120,712 A 2/1964 Menken
3,121,430 A 2/1964 O'Reilly
3,204,678 A 9/1965 Worcester
3,251,076 A 5/1966 Burke
3,284,264 A 11/1966 O'Rourke
3,335,045 A 8/1967 Post
3,366,525 A 1/1968 Jackson
3,469,576 A 9/1969 Smith et al.
3,568,227 A 3/1971 Dunham
3,589,037 A 6/1971 Gallagher
3,608,215 A * 9/1971 Fukuoka
3,685,176 A 8/1972 Rudy
3,758,964 A 9/1973 Nishimura
3,765,422 A 10/1973 Smith
4,017,931 A 4/1977 Golden
4,054,960 A 10/1977 Pettit et al.
4,115,934 A 9/1978 Hall
4,129,951 A 12/1978 Petrosky
4,167,795 A 9/1979 Lambert, Jr.
4,183,156 A 1/1980 Rudy
4,187,620 A 2/1980 Seiner
4,217,705 A 8/1980 Donzis
4,219,945 A 9/1980 Rudy
4,271,606 A 6/1981 Rudy
4,287,250 A 9/1981 Rudy
4,292,702 A 10/1981 Phillips
4,297,797 A 11/1981 Meyers
4,305,212 A 12/1981 Coomer
4,328,599 A 5/1982 Mollura
4,358,902 A 11/1982 Cole et al.
4,431,003 A 2/1984 Sztancsik
4,446,634 A 5/1984 Johnson et al.
4,458,430 A 7/1984 Peterson
4,483,030 A 11/1984 Plick et al.
4,486,964 A 12/1984 Rudy
4,506,460 A 3/1985 Rudy
4,535,553 A * 8/1985 Derderian et al.
4,547,919 A 10/1985 Wang
4,662,087 A 5/1987 Beuch
4,670,995 A * 6/1987 Huang
4,686,130 A 8/1987 Kon
4,722,131 A 2/1988 Huang
4,744,157 A 5/1988 Dubner
4,779,359 A 10/1988 Famolare, Jr.
4,782,602 A 11/1988 Lakic
4,803,029 A 2/1989 Iversen et al.
4,817,304 A 4/1989 Parker et al.
4,823,482 A 4/1989 Lakic
4,845,338 A 7/1989 Lakic
4,845,861 A 7/1989 Moumgdgian
4,874,640 A 10/1989 Donzis
4,891,855 A 1/1990 Cheng-Chung
4,906,502 A 3/1990 Rudy
4,912,861 A 4/1990 Huang
4,936,029 A 6/1990 Rudy
4,965,899 A 10/1990 Sekido et al.
4,991,317 A 2/1991 Lakic
4,999,931 A * 3/1991 Vermeulen
4,999,932 A 3/1991 Grim
5,022,109 A 6/1991 Pekar
5,025,575 A 6/1991 Lakic
5,042,176 A * 8/1991 Rudy
5,044,030 A 9/1991 Balaton
5,046,267 A 9/1991 Kilgore et al.
5,083,361 A 1/1992 Rudy
5,092,060 A * 3/1992 Frachey et al.
5,104,477 A 4/1992 Williams et al.
5,155,927 A 10/1992 Bates et al.
5,158,767 A 10/1992 Cohen et al.
5,179,792 A 1/1993 Brantingham
5,193,246 A 3/1993 Huang
5,199,191 A 4/1993 Moumdjian
5,224,277 A 7/1993 Sang Do
5,224,278 A 7/1993 Jeon
5,228,156 A 7/1993 Wang
5,235,715 A 8/1993 Donzis
5,238,231 A 8/1993 Huang
5,245,766 A 9/1993 Warren
5,253,435 A 10/1993 Auger et al.
5,257,470 A 11/1993 Auger et al.
5,297,349 A 3/1994 Kilgore
5,335,382 A 8/1994 Huang
5,337,492 A 8/1994 Anderie et al.
5,353,523 A 10/1994 Kilgore et al.
5,355,552 A 10/1994 Huang
5,367,791 A 11/1994 Gross et al.
5,406,719 A 4/1995 Potter
5,425,184 A 6/1995 Lyden et al.
5,493,791 A * 2/1996 Kramer
5,543,194 A 8/1996 Rudy
5,558,395 A 9/1996 Huang
5,572,804 A * 11/1996 Skaja et al.
5,595,004 A 1/1997 Lyden et al.
5,625,964 A 5/1997 Lyden et al.
5,669,161 A 9/1997 Huang
5,686,167 A 11/1997 Rudy
5,713,141 A 2/1998 Mitchell et al.
5,741,568 A 4/1998 Rudy
5,753,061 A 5/1998 Rudy
5,755,001 A 5/1998 Potter et al.
5,771,606 A 6/1998 Litchfield et al.
5,802,739 A 9/1998 Potter et al.
5,830,553 A 11/1998 Huang
5,832,630 A 11/1998 Potter
5,846,063 A 12/1998 Lakic
5,902,660 A 5/1999 Huang
5,907,911 A 6/1999 Huang
5,916,664 A 6/1999 Rudy
5,925,306 A 7/1999 Huang
5,937,462 A 8/1999 Huang
5,952,065 A 9/1999 Mitchell et al.
5,976,451 A 11/1999 Skaja et al.
5,979,078 A 11/1999 McLaughlin
5,987,780 A 11/1999 Lyden et al.
5,993,585 A 11/1999 Goodwin et al.
6,103,340 A 1/2000 Bonk et al.
6,027,683 A 2/2000 Huang
6,029,962 A * 2/2000 Shorten et al.
6,055,746 A 5/2000 Lyden et al.
6,065,150 A 5/2000 Huang
6,092,310 A * 7/2000 Schoesler
6,098,313 A 8/2000 Skaja
6,119,371 A 9/2000 Goodwin et al.
6,127,010 A 10/2000 Rudy
6,128,937 A 10/2000 Huang
6,176,025 B1 1/2001 Patterson et al.

FOREIGN PATENT DOCUMENTS

EP 0 215 974 A1 9/1985
EP 0 605 485 A1 9/1992
EP 0 780 064 A2 6/1997
FR 1195549 11/1959
FR 1406610 11/1965
FR 2144464 1/1973
FR 2404413 4/1979
FR 2407008 5/1979

| | | |
|---|---|---|
| FR | 2483321 | 4/1981 |
| FR | 2614510 | 4/1987 |
| FR | 2639537 | 11/1988 |
| GB | 14955 | 8/1893 |
| GB | 7441 | 3/1906 |
| GB | 233387 | 1/1924 |
| GB | 978654 | 12/1964 |
| GB | 1128764 | 10/1968 |
| JP | 266718 | 7/1992 |
| JP | 6-181802 | 7/1994 |
| TW | 75100322 | 1/1975 |
| TW | 54221 | 6/1978 |
| WO | WO89/10074 | 11/1989 |
| WO | WO90/10396 | 9/1990 |
| WO | WO91/11928 | 8/1991 |
| WO | WO91/11931 | 8/1991 |
| WO | WO92/08384 | 5/1992 |
| WO | WO95/20332 | 8/1995 |
| WO | WO 98/09546 | 3/1998 |

* cited by examiner

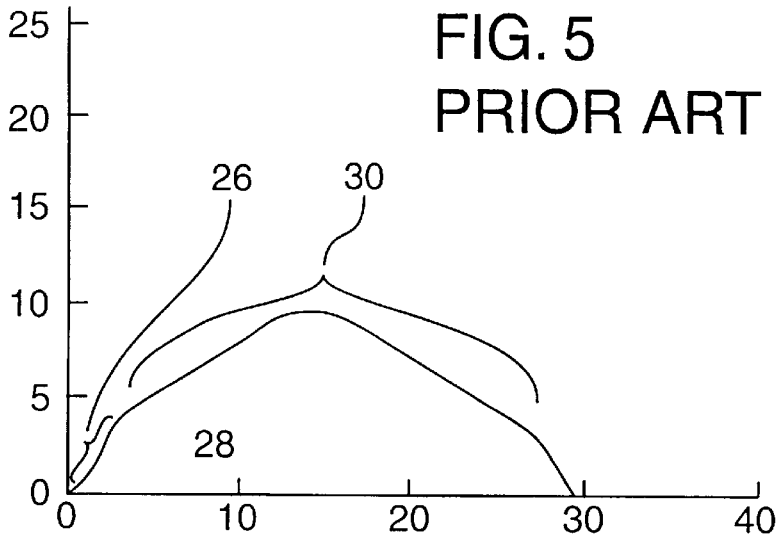
FIG. 5
PRIOR ART
FIG. 6
PRIOR ART
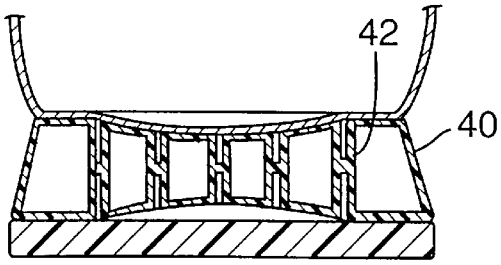
FIG. 7
PRIOR ART
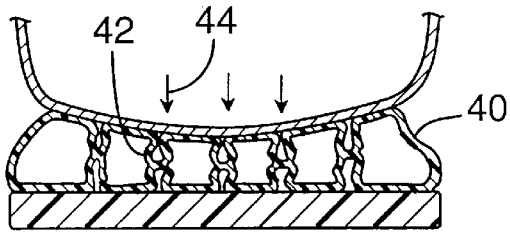
FIG. 8
PRIOR ART
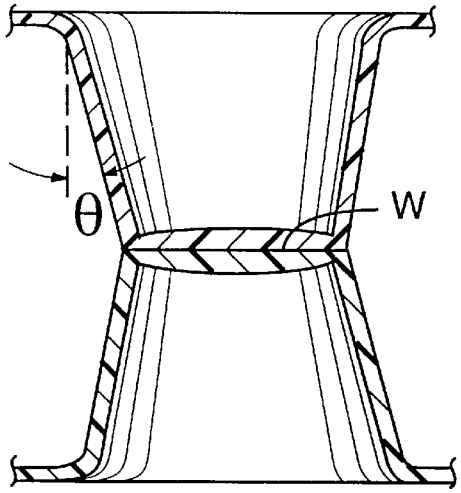

FOOTWEAR BLADDER WITH CONTROLLED FLEX TENSILE MEMBER

FIELD OF THE INVENTION

The present invention relates to an improved cushioning member and method of making the same, and more particularly to a fluid filled bladder having controlled flex tensile members which allows for the formation of complex-curved contours and shapes while minimizing the amount of surrounding foam material. The present invention also relates to footwear wherein the bladder with controlled flex tensile members is used as a cushioning device within a sole.

BACKGROUND OF THE INVENTION

Considerable work has been done to improve the construction of cushioning members which utilize fluid filled bladders such as those used in shoe soles. Although with the recent developments in materials and manufacturing methods, fluid filled bladder members have greatly improved in versatility, there remain problems associated with obtaining optimum performance and durability. Fluid filled bladder members are commonly referred to as "air bladders," and the fluid is generally a gas which is commonly referred to as "air" without intending any limitation as to the actual gas composition used.

Closed-celled foam is often used as a cushioning material in shoe soles and ethylene-vinyl acetate copolymer (EVA) foam is a common material. In many athletic shoes, the entire midsole is comprised of EVA. While EVA foam can easily be cut into desired shapes and contours, its cushioning characteristics are limited. One of the advantages of gas filled bladders is that gas as a cushioning compound is generally more energy efficient than closed-cell foam. This means that a shoe sole comprising a gas filled bladder provides superior cushioning response to loads than a shoe sole comprising only foam. Cushioning generally is improved when the cushioning component, for a given impact force, spreads the impact force over a longer period of time, resulting in a smaller impact force being transmitted to the wearer's body. Even shoe soles comprising gas filled bladders include some foam, and a reduction in the amount of foam will generally afford better cushioning characteristics.

Some major engineering problems associated with the design of air bladders formed of perimeter barrier layers include: (I) obtaining complex-curved, contoured shapes without the formation of deep peaks and valleys in the cross section which require filling in or moderating with foams or plates; (ii) ensuring that the means employed to give the air bladder its complex-curved, contoured shape does not significantly compromise the cushioning benefits of air; and (iii) reducing fatigue failure of the bladders caused by cyclic folding of portions of the bladder.

The prior art is replete with attempts to address these difficulties, but often presenting new obstacles in the process of addressing these problems. Most of the prior art discloses some type of tensile member. A tensile member is an element associated with the bladder which ensures a fixed, resting relation between the top and bottom barrier layers when the air bladder is fully inflated, and which often is in a state of tension while acting as a restraining means to maintain the general form of the bladder.

Some prior art constructions are composite structures of air bladders containing foam or fabric tensile members. One type of such composite construction prior art concerns air bladders employing an open-celled foam core as disclosed U.S. Pat. Nos. 4,874,640 and 5,235,715 to Donzis. These cushioning elements do provide latitude in their design in that the open-celled foam cores allow for complex-curved and contoured shapes of the bladder without deep peaks and valleys. However, bladders with foam core tensile members have the disadvantage of unreliable bonding of the core to the barrier layers. FIGS. 1 and 2 illustrate a cross section of a prior art bladder 10 employing an open-celled foam core 12 as a tensile member. FIG. 2 illustrates the loaded condition of bladder 10 with load arrows 14. One of the main disadvantages of bladder 10 is that foam core 12 gives the bladder its shape and thus must necessarily function as a cushioning member which detracts from the superior cushioning properties of air alone. One reason for this is that in order to withstand the high inflation pressures associated with air bladders, the foam core must be of a high strength which requires the use of a higher density foam. The higher the density of the foam, the less the amount of available volume in the bladder for gas. Consequently, the reduction in the amount of gas in the bladder decreases the benefits of gas cushioning.

Even if a lower density foam is used, a significant amount of available volume is sacrificed which means that the deflection height of the bladder is reduced due to the presence of the foam, thus accelerating the effect of "bottoming out." Bottoming out refers to the premature failure of a cushioning device to adequately decelerate an impact load. Most cushioning devices used in footwear are non-linear compression based systems, increasing in stiffness as they are loaded. Bottoming out is the point where the cushioning system is unable to compress any further. Also, the elastic foam performs a significant portion of the cushioning function and is subject to compression set. Compression set refers to the permanent compression of foam after repeated loads which greatly diminishes its cushioning aspects. In foam core bladders, compression set occurs due to the internal breakdown of cell walls under heavy cyclic compression loads such as walking or running. The walls of individual cells constituting the foam structure abrade and tear as they move against one another and fail. The breakdown of the foam exposes the wearer to greater shock forces.

Another type of composite construction prior art concerns air bladders which employ three dimensional fabric as tensile members such as those disclosed in U.S. Pat. Nos. 4,906,502 and 5,083,361 to Rudy, which are hereby incorporated by reference. The bladders described in the Rudy patents have enjoyed considerable commercial success in NIKE, Inc. brand footwear under the name Tensile-Air® and Zoom™. Bladders using fabric tensile members virtually eliminate deep peaks and valleys, and the methods described in the Rudy patents have proven to provide an excellent bond between the tensile fibers and barrier layers. In addition, the individual tensile fibers are small and deflect easily under load so that the fabric does not interfere with the cushioning properties of air.

One shortcoming of these bladders is that currently there is no known manufacturing method for making complex-curved, contoured shaped bladders using these fabric fiber tensile members. The bladders may have different heights, but the top and bottom surfaces remain flat with no contours and curves. FIGS. 3 and 4 illustrate a cross section of a prior art bladder 20 employing a three dimensional fabric 22 as a tensile member. FIG. 4 illustrates the loaded condition of bladder 20 with load arrows 24. As can be seen in FIGS. 3 and 4, the surfaces of bladder 20 are flat with no contours or slopes.

Another disadvantage is the possibility of bottoming out. Although the fabric fibers easily deflect under load and are individually quite small, the sheer number of them necessary to maintain the shape of the bladder means that under high loads, a significant amount of the total deflection capability of the air bladder is reduced by the volume of fibers inside the bladder and the bladder can bottom out.

One of the primary problems experienced with the fabric fibers is that these bladders are initially stiffer during initial loading than conventional gas filled bladders. This results in a firmer feel at low impact loads and a stiffer "point of purchase" feel than belies their actual cushioning ability. This is because the fabric fibers have a relatively low elongation to properly hold the shape of the bladder in tension, so that the cumulative effect of thousands of these relatively inelastic fibers is a stiff effect. The tension of the outer surface caused by the low elongation or inelastic properties of the tensile member results in initial greater stiffness in the air bladder until the tension in the fibers is broken and the solitary effect of the gas in the bladder can come into play which can affect the point of purchase feel of footwear incorporating bladder 20. The Peak G curve, Peak G v. time in milliseconds, shown in FIG. 5 reflects the response of bladder 20 to an impact. The portion of the curve labeled 26 corresponds to the initial stiffness of the bladder due to the fibers under tension, and the point labeled 28 indicates the transition point in which the tension in the fibers of fabric 22 are "broken" and give way to more of the cushioning effects of the air. The area of the curve labeled 30 corresponds to loads which are cushioned with more compliant gas. The Peak G curve is a plot generated by an impact test such as those described in the *Sport Research Review, Physical Tests,* published by NIKE, Inc. as a special advertising section, January/February 1990, the contents of which is hereby incorporated by reference.

Another category of prior art concerns air bladders which are injection molded, blow-molded or vacuum-molded such as those disclosed in U.S. Pat. No. 4,670,995 to Huang and U.S. Pat. No. 4,845,861 to Moumdjian, which are incorporated herein by reference. These manufacturing techniques can produce bladders of any desired contour and shape while reducing deep peaks and valleys. The main drawback of these air bladders is in the formation of stiff, vertically aligned columns of elastomeric material which form interior columns and interfere with the cushioning benefits of the air. These bladders are designed to support the weight of the wearer. FIGS. 6 and 7 illustrate cross sections of a prior art bladder 40 which is made by injection molding, blow-molding or vacuum-forming with vertical columns 42. FIG. 7 illustrates bladder 40 in the loaded condition with load arrows 44. Since these interior columns are formed or molded in the vertical position, there is significant resistance to compression upon loading which can severely impede the cushioning properties of the air.

In Huang '995 it is taught to form strong vertical columns so that they form a substantially rectilinear cavity in cross section. This is intended to give substantial vertical support to the cushion so that the cushion can substantially support the weight of the wearer with no inflation. Huang '995 also teaches the formation of circular columns using blow-molding. In this prior art method, two symmetrical rod-like protrusions of the same width, shape and length extend from the two opposite mold halves to meet in the middle and thus form a thin web in the center of a circular column. These columns are formed of a wall thickness and dimension sufficient to substantially support the weight of a wearer in the uninflated condition. Further, no means are provided to cause the columns to flex in a predetermined fashion which would reduce fatigue failures. Huang's columns are also prone to fatigue failure due to compression loads which force the columns to buckle and fold unpredictably. Under cyclic compression loads, the buckling can lead to fatigue failure of the columns.

FIG. 8 shows a close-up view of a prior art column similar to those shown in Huang with a thin web in the middle of the column halves formed by a center weld W and a slight draft angle θ to the column halves. While Huang's columns do not appear to have a draft angle, the commercial embodiments of the bladder taught by Huang have shown a draft angle similar to that shown in FIG. 8.

Included in this prior art category of molded bladders are bladders having inwardly directed indentations as disclosed in U.S. Pat. No. 5,572,804 to Skaja et al, which is hereby incorporated by reference. Skaja et al. disclose a shoe sole component comprising inwardly directed indentations in the top and bottom members of the sole components. Support members or inserts provide some controlled collapse of the material to create areas of cushioning and stability in the component. The inserts are configured to extend into the outwardly open surfaces of the indentations. The indentations can be formed in one or both of the top and bottom members. The indented portions are proximate to one another and can be engaged with one another in a fixed or non-fixed relation. In the Skaja patent, indentations that are generally hemispherical in shape and symmetrical about a central orthogonal axis are taught. The outside shape of the indentation, that is, the shape outlined at the surface of the bladder component is circular. The inserts have the same shape as the indentations. The hemispherical indentations and mating support members or inserts respond to compression by collapsing symmetrically about a center point. While the hemispherical indentations and inserts of Skaja provide for some variation in cushioning characteristics by placement, size and material, there is no provision for biasing or controlling the compression or collapse in a desired direction upon loading. The indentations and the mating inserts contribute to the cushioning response of the bladder which is opposed to the goal of the present invention in which the controlled collapse members are engineered specifically to not interfere with the cushioning response of gas or air.

Yet another prior art category concerns bladders using a corrugated middle film as an internal member as disclosed in U.S. Pat. No. 2,677,906 to Reed which describes an insole of top and bottom sheets connected by lateral connection lines to a corrugated third sheet placed between them. The top and bottom sheets are heat sealed around the perimeter and the middle third sheet is connected to the top and bottom sheets by lateral connection lines which extend across the width of the insole. An insole with a sloping shape is thus produced, however, because only a single middle sheet is used, the contours obtained must be uniform across the width of the insole. By use of the attachment lines, only the height of the insole from front to back may be controlled and no complex-curved, contoured shapes are possible. Another disadvantage of Reed is that because the third, middle sheet is a continuous sheet, all the various chambers are independent of one another and must be inflated individually which is impractical for mass production.

The alternative embodiment disclosed in the Reed patent uses just two sheets with the top sheet folded upon itself and attached to the bottom sheet at selected locations to provide rib portions and parallel pockets. The main disadvantage of this construction is that the ribs are vertically oriented and similar to the columns described in the patents to Huang and Moumdjian, and would resist compression and interfere with and decrease the cushioning benefits of air. As with the first embodiment of Reed, each parallel pocket thus formed must be separately inflated.

A prior bladder and method of construction using flat films is disclosed in U.S. Pat. No. 5,755,001 to Potter et al, which is hereby incorporated by reference. The interior film layers are bonded to the envelope film layers of the bladder which defines a single pressure chamber. The interior film layers act as tensile members which are biased to compress upon loading. The biased construction reduces fatigue failures and resistance to compression. The bladder comprises a single chamber inflated to a single pressure with the tensile member interposed to give the bladder a complex-contoured profile. There is, however, no provision for multiple layers of fluid in the bladder which could be inflated to different pressures providing improved cushioning characteristics and point of purchase feel.

Another well known type of bladder is formed using blow molding techniques such as those discussed in U.S. Pat. No. 5,353,459 to Potter et al, which is hereby incorporated by reference. These bladders are formed by placing a liquefied elastomeric material in a mold having the desired overall shape and configuration of the bladder. The mold has an opening at one location through which pressurized gas is introduced. The pressurized gas forces the liquefied elastomeric material against the inner surfaces of the mold and causes the material to harden in the mold to form a bladder having the preferred shape and configuration.

There exists a need for an air bladder with a suitable tensile member which solves all of the problems listed above: complex-curved, contoured shapes; elimination of deep peaks and valleys; no interference with the cushioning benefits of air alone; and the provision of a reliable bond between tensile member and outer barrier layers. As discussed above, while the prior art has been successful in addressing some of these problems, they each have their disadvantages and fall short of a complete solution.

SUMMARY OF THE INVENTION

The present invention pertains to a bladder with controlled flex connecting members extending between the top and bottom outer layers of bladder. The bladder of the present invention may be incorporated into a sole assembly of an article of footwear to provide cushioning. When pressurized, the outer layers are placed under tension, and the connecting members function as tension members. The bladder provides a reliable bond between the tensile members and the outer barrier layers, and can be constructed to have complex-curved, contoured shapes without interfering with the cushioning properties of air. A complex-contoured shape refers to varying the surface of the bladder in more than one direction. The present invention overcomes the enumerated problems with the prior art while avoiding the design trade-offs associated with the prior art attempts.

In accordance with one aspect of the present invention, a bladder is formed by blow-molding or rotational molding. Both of these methods create internal connection/tensile members which are integral with the outer perimeter layer. Since the outer perimeter and the internal tensile members are formed at the same time and of the same material, bonding problems between layers is eliminated and manufacturing is simplified. By utilizing pins in the blow-molded or rotational mold, tensile column members are formed which can provide a finely contoured shape, but which do not significantly interfere with the cushioning properties of the air, when the bladder contains air or another fluid. It is desirable that the tensile members compress easily under relatively low loads, those exceeding ½ body weight (35 kg) and preferably below 25 kg. In order to prevent fatigue stress on the members, a predetermined flex point is molded into at least a portion of each column. This assures that the members will flex under relatively low loads and that the flexure will occur in a predictable manner, eliminating the prior art problem of fatigue failure in the vertical columns.

To ensure that the tensile members do not interfere with the cushioning properties of air they are configured to be sufficiently flexible to receive compressive loads but are durable even under repeated loading. Broadly, there are two configurations: one in which the tensile member is constructed to collapse upon compressive loading, and one in which the tensile member is constructed to bend or fold like a hinge upon compressive loading in a predetermined location.

In another aspect of the present invention the shape of the flexible tensile column members and the interface at the flex point are manipulated to assist in finely tuning the cushioning properties of the final bladder. Differently shaped cross-sections of columns, e.g. circles, ovals, squares, rectangles, triangles, spirals, half-moons, helices, etc., impart different amounts of resistance to compression and exhibit varying flex properties. Also, the placement, thickness and number of flex points can significantly effect the bending, collapsing, or folding properties of the tensile members. For example, multiple accordion-like pleats molded into the columns impart more flexibility than a single notch or pleat of the same thickness. Additionally, the columns need not be arranged perpendicular to the plane of the bladder surface. By forming the tensile members at various angles, the direction that the tensile member bends or folds can be further controlled.

Yet another aspect of the invention is to vary the lengths of the opposing ends of the tensile columns by utilizing pin or rod-like protrusions of different lengths in the mold, the joint or hinge in the tensile members can be formed off-center. The longer of the two pin or rod-like protrusions forms a column portion of longer length than the shorter pin or rod-like protrusion. This variation in the tensile column's length can be manipulated to direct the flexing of the column under compression.

In another embodiment, the flex point of the tensile column is manipulated by altering the cross-section size of the pin or rod-like protrusions in the mold, whereby the pins or rod-like protrusions in one mold half are larger in cross-section than the ones in the opposing half. This produces a tensile column with one portion larger than the other which allows the smaller portion of the column to telescope or nest into the larger portion upon loading. In such a construction, the larger portion collapses around the smaller portion, rather than acting as a hinge.

In yet another embodiment, spring elements such as elastomeric sheets, may be insert-molded during the blow-molding process to direct the flex properties of the columns. For example, a thin strip of thermoplastic urethane of the same type used to form the main bladder can be located in the mold in such a way that it spans the gap between two of the columns forming pins or rod-like protrusions located in the same half of the mold. The resulting columns formed would be tied together horizontally in the center web portion by the strip. This would prevent columns from flexing easily in any direction except inwardly toward the shared strip.

Another method of manipulating the flex properties of the tensile columns is to vary the draft angle of the pins or rod-like protrusions in the mold which form the columns. A draft angle of zero degrees would produce a column with essentially vertical walls. A draft angle of 5° to 45° is needed in order to cause the column to flex in a predictable manner. In general an increased draft angle in combination with another structural difference such as asymmetry will provide the desired predicted location of collapse. Engineering the location of collapse or flexure in this manner prevents the failures noted with prior art devices. By manipulating some or all of the above factors in various combinations, cross-sectional size, length, shape, hinges, thickness, draft angles and symmetry, it is possible to finely tune the cushioning properties of the bladder and select the most appropriate flex characteristic to prevent fatigue failures and prevent the tensile columns from significantly detracting or interfering with the cushioning benefits and feel of the air.

The present invention provides a bladder with tensile members of complex-curved, contoured shapes without deep peaks and valleys, which facilitates utilization of the cushioning properties of air and which provides a reliable bond between the tensile members and the outer barrier layers of the bladder. The tensile members are columns formed integrally with the barrier layer and are formed with predetermined flex points which are constructed to flex upon compression by collapsing, bending, or rolling so that the tensile members do not substantially interfere with the cushioning effects of the air. The tensile members are less susceptible to fatigue failures when they are not required to perform a significant supportive function and the flex point is constructed for taking repeated compressive loads. This configuration ensures that the tensile members will not compromise the cushioning properties of air.

These and other features and advantages of the invention may be more completely understood from the following detailed description of the preferred embodiment of the invention with reference to the accompanying drawings.

BRIEF DESCRIPTION OF THE DRAWINGS

FIG. 5 is a Peak G response curve of the prior art bladder of FIG. 3.

FIG. 6 is a cross section of a prior art bladder using vertical columns as tensile members formed by injection molding, blow-molding or vacuum-forming.

FIG. 7 is a cross section of the prior art bladder of FIG. 6 shown in the loaded condition.

FIG. 8 is a close-up view of a portion of a prior art bladder similar to that shown in FIG. 6, illustrating a vertical column tensile member.

DETAILED DESCRIPTION OF THE PREFERRED EMBODIMENTS

In general, the controlled flex connecting members depicted in the figures are schematic representations of variously configured connecting members that can be provided in bladders. When the bladders are sealed and inflated with a fluid, the connecting members are placed under tension and act as tensile members. Since, in a preferred embodiment, the bladder is inflated, the connecting members will be referred to as tensile members; however, it should be understood that when the bladders are in an uninflated state, these members act as controlled flex connecting members. A plurality of one type of these tensile members or a combination of two or more types of tensile members can be provided in a bladder to lend the bladder a desired shape, contour and cushioning characteristics. The tensile members are integral with the top and bottom outer perimeter of the bladder and are created by positioning small diameter pins or forms in correspondence on both of the facing halves of a mold so that tensile members are formed of the barrier material wherever the pins or forms were placed when the bladder is molded. The following detailed description describes a number of possible tensile member structures, and then describes an exemplary number of inflatable bladders having controlled flex tensile members provided therein. The bladders described below embody some exemplary possibilities given the technique of the present invention. It is noted that a multitude of configurations other than those specifically described herein are contemplated to be within the scope of this invention. Bladders with controlled flex tensile members are particularly useful as cushioning devices within soles of footwear.

The preferred method of manufacturing is blow-molding. Blow-molding is a well known technique which is well suited to economically produce large quantities of consistent articles. The use of one, homogenous material provides the articles with inherently good adhesion between the perimeter and interior tensile members due to the fact that they are contiguous with each other. Blow-molding produces clean, cosmetically appealing articles with small inconspicuous seams. Many other prior art bladder manufacturing methods require multiple manufacturing steps, components and materials which makes them difficult and costly to produce. Some prior art methods form conspicuously large seams around their perimeters which can be cosmetically unappealing. Two other known manufacturing methods that can produce good results are rotational molding and injection molding.

Figure 1:
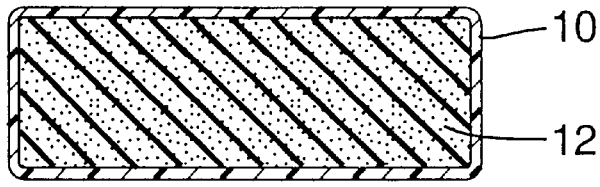
FIG. 1 PRIOR ART
FIG. 1 is a cross section of a prior art bladder using an open-celled foam core as a tensile member.
Figure 2:
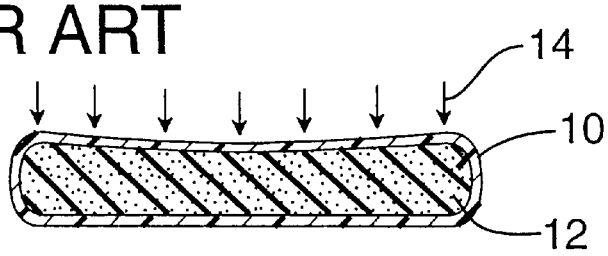
FIG. 2 PRIOR ART
FIG. 2 is a cross section of the prior art bladder of FIG. 1 shown in the loaded condition.
Figure 3:
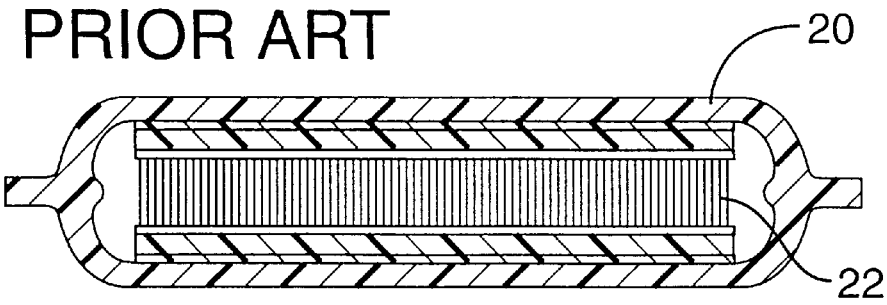
FIG. 3 PRIOR ART
FIG. 3 is a cross section of a prior art bladder using fabric fibers as tensile members.
Figure 4:
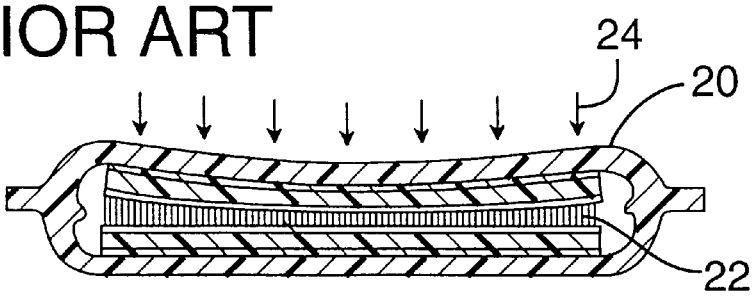
FIG. 4 PRIOR ART
FIG. 4 is a cross section of the prior art bladder of FIG. 3 shown in the loaded condition.
Figure 9:
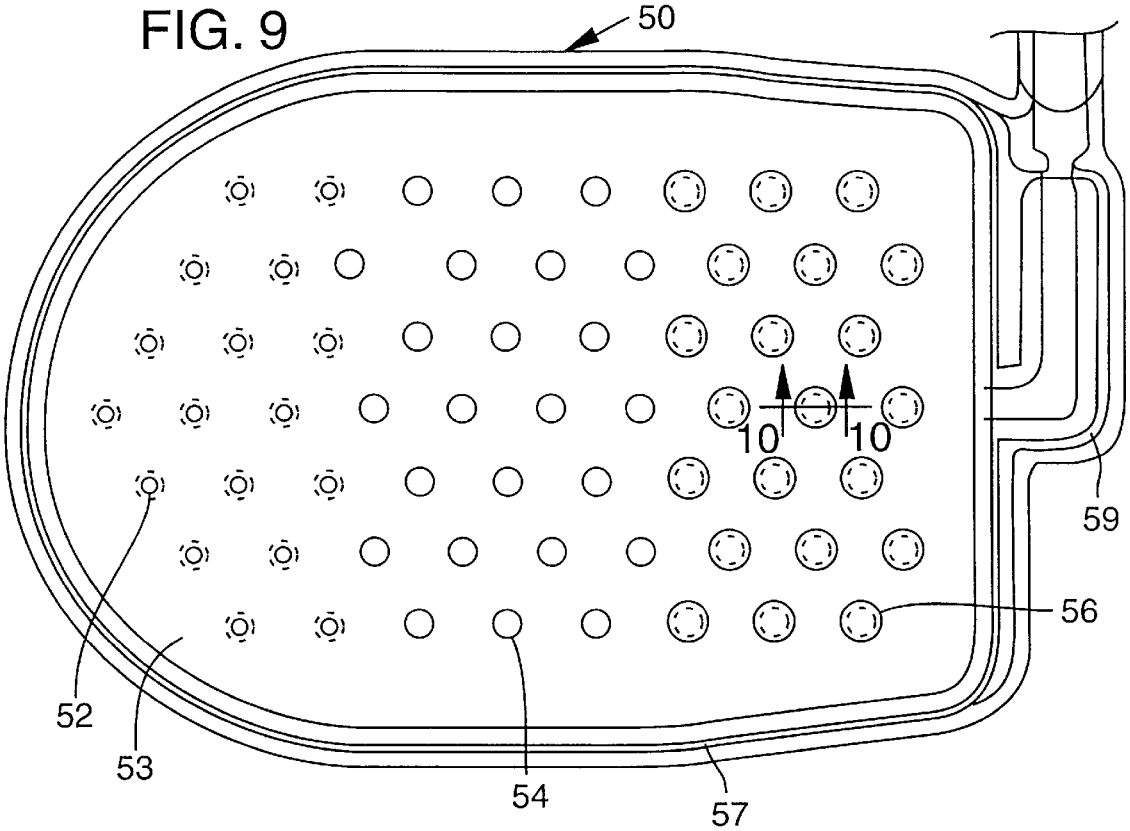
FIG. 9 is a plan view of a bladder in accordance with a preferred embodiment of the present invention.
Figure 10:
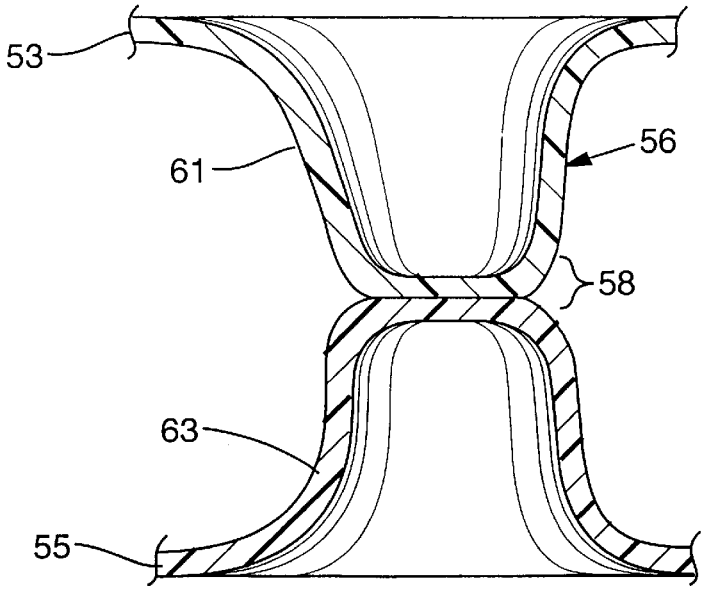
FIG. 10 is a detailed elevational view of a column tensile member taken along line 10—10 of FIG. 9, shown in the unloaded state.

Referring now to FIG. 9, a preferred embodiment of a heel bladder 50 is shown having vertical tensile members of varying diameter distributed across the bladder. Heel bladder 50 includes a first, or top, barrier layer 53 and a second, or bottom, barrier layer 55. The top and bottom barrier layers 53, 55 are joined to one another along a perimeter 57 to form a sealed chamber. An inlet tube 59 is provided as one way of supplying an inflatent fluid to the sealed chamber. The tensile members of bladder 50 are columnar in shape, with the most slender ones 52 arranged in the rear strike area, medium diameter columns 54 in the central region and larger diameter columns 56 in the forwardmost area. The larger the diameter of the column, the more stiffness it will exhibit upon compressive loading. The area in need of most cushioning in this bladder, the rear strike area, has relatively slender columns to provide a more cushioned response. A detail of a column 56 is shown in FIG. 10 in which controlled flex point 58 is positioned generally in the center of the length of the column. A first portion 61 of column 56 is formed integral with first layer 53 and extends into the sealed chamber of bladder 50. Similarly, a second portion 63 of column 56 is formed integral with second layer 55 and also extends into the sealed chamber. Such integral formation of first and second column portions is a preferred technique for all tensile members discussed herein. Flex point 58 is formed at the juncture of first and second portions 61, 63 that make up column 56, and compressive loading will tend to buckle the column at that predetermined and reinforced flex point.

Flex point 58 provides a predetermined location of flexure for tensile column 56 in response to a compression load. The flexing of column 56 about flex point 58 occurs like a mechanical hinge, so that a hinge area is located about flex point 58. This selected flex point acts to prevent buckling and bending about random points of the column and the potential for fatigue failure associated with such uncontrolled or undirected flexion.

In general, factors such as wall thickness, column height, and diameter must be taken into account in designing controlled flex tensile members. A shorter column with a thicker wall section and greater diameter will require a greater draft angle to flex under the same load as a taller column with a thinner wall section and a smaller diameter. When one or more of these parameters is adjusted, they yield bladders with different cushioning characteristics due to the differences in the tensile members.

Column 56 illustrates a column with generally equal portions joined together in axial alignment. The portions of a controlled flex member however, can be different in length, diameter, shape and alignment as shown in the following alternative embodiments.

Bladder 50 may be made of a resilient, thermoplastic elastomeric barrier film, such as polyester polyurethane, polyether polyurethane, such as a cast or extruded ester based polyurethane film having a shore "A" hardness of 80–95, e.g., Tetra Plastics TPW-250. Other suitable materials can be used such as those disclosed in U.S. Pat. No. 4,183,156 to Rudy, which is incorporated by reference. Among the numerous thermoplastic urethanes which are particularly useful in forming the film layers are urethanes such as Pellethane™, (a trademarked product of the Dow Chemical Company of Midland, Mich.), Elastollan® (a registered trademark of the BASF Corporation) and ESTANE® (a registered trademark of the B. F. Goodrich Co.), all of which are either ester or ether based and have proven to be particularly useful. Thermoplastic urethanes based on polyesters, polyethers, polycaprolactone and polycarbonate macrogels can also be employed. Further suitable materials could include thermoplastic films containing crystalline material, such as disclosed in U.S. Pat. Nos. 4,936,029 and 5,042,176 to Rudy, which are incorporated by reference; polyurethane including a polyester polyol, such as disclosed in U.S. Pat. No. 6,013,340 to Bonk et al., which is incorporated by reference; or multi-layer film formed of at least one elastomeric thermoplastic material layer and a barrier material layer formed of a copolymer of ethylene and vinyl alcohol, such as disclosed in U.S. Pat. No. 5,952,065 to Mitchell et al., which is incorporated by reference.

Bladder 50 can be sealed to hold air or other fluid at ambient pressure, or can be pressurized with an appropriate fluid, for example, hexafluorethane, sulfur hexafluoroide, nitrogen, air, or other gases such as those disclosed in the aforementioned '156, '029, or '176 patents to Rudy, or the '065 patent to Mitchell et al. If pressurized, the fluid or gas can be placed in bladder 50 through inflation tube 59 in a conventional manner by means of a needle or hollow welding tool. After inflation, the bladder can be sealed at the juncture of the body of bladder 50 and inflation tube 59, and the remainder of tube 59 can be cut off. Alternatively, tube 59 can be sealed by the hollow welding tool around the inflation point.

Figure 11:
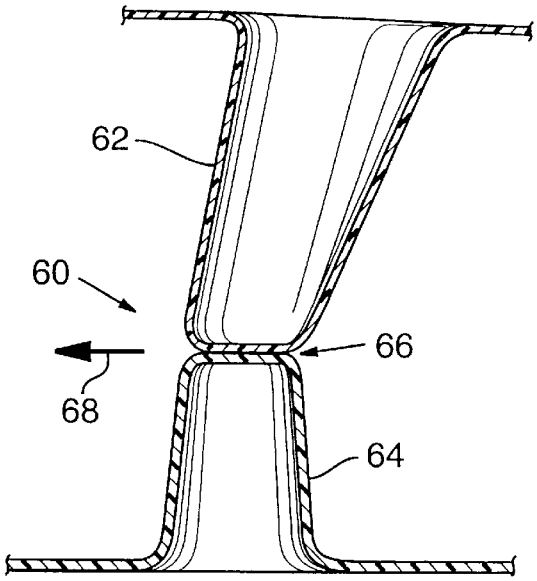
FIG. 11 is a detailed elevational view of a column tensile member in accordance with another preferred embodiment of the present invention, shown in an unloaded state.

Column tensile member 60 is shown in FIG. 11 and depicts another preferred embodiment. The top portion 62 of column 60 is slightly longer than bottom portion 64, and is also diagonally appointed with respect to the straight vertical bottom portion. A flex point 66 is defined between the top and bottom portions of column 60. In this particular column, diagonal top portion 62 slants to the right thereby biasing column 60 to bend at flex point 66 to the left, that is, in the direction of arrow 68, in response to a compressive load. This is accomplished by placing the pin for the top portion of the column at an angle with respect to the vertical in the mold for the bladder.

By this configuration, not only is the point of flexion controlled, but the direction of flexion as well. This type of controlled direction column would be a particularly advantageous tensile member to place at the periphery of a bladder, for example, where the column would be oriented such that flex point 66 would move inward in response to a compressive load. An inward deflection of flex point 66 would ensure that column 60 would not contact or interfere with the side wall of the bladder. A controlled direction column like column 60 would be advantageous to use anywhere that contact with other elements during flexion must be avoided. The length of the diagonal top portion with respect to the vertical bottom portion can be modulated to control the amount of deflection of joint 66. The relationship of the top and bottom portions can be switched so that the top portion is vertical and the bottom portion is diagonal. Of course, the direction can be altered by varying the direction of the diagonal slant to the diagonal portion, and the draft angle of the diagonal slant can also be adjusted as desired.

Figure 12:
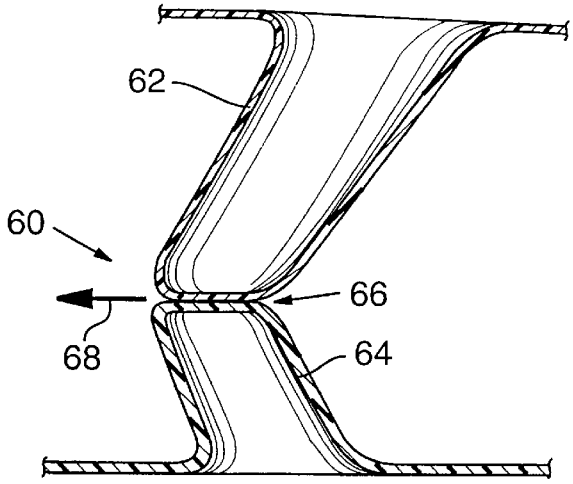
FIG. 12 is a detailed elevational view of a column tensile member in accordance with another preferred embodiment of the present invention, shown in an unloaded state.

As shown in FIG. 12, a tensile member formed of two diagonal portions configured in a sideways "V" shape is also contemplated to be within the scope of the invention. Such a tensile member would flex more easily in response to lower compressive loads. The choice of placement, configuration and relative lengths of the top and bottom portions of a tensile member are all variables and changing these properties results in an array of different cushioning and contour possibilities.

Figure 13:
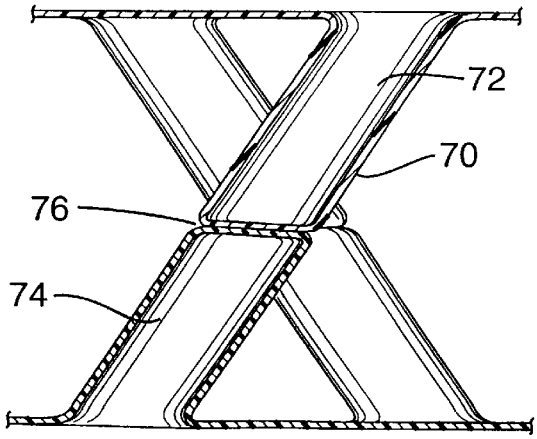
FIG. 13 is a detailed elevational view of a column tensile member in accordance with another preferred embodiment of the present invention, shown in an unloaded state.

FIG. 13 illustrates another preferred embodiment of a tensile member in which column 70 is depicted. Top portion 72 and bottom portion 74 of column 70 are both diagonally appointed such that their longitudinal axes are aligned. A flex point 76 is defined between the top and bottom portions of column 70 at a midway point. Bottom portion 74 is shown slanted toward the right and top portion 72 also slants toward the right as it extends to the top barrier layer. Column 70 would tend to flex more easily in response to a compressive load than a straight vertical column, and can be used wherever a more sensitive response is needed.

This configuration can be accomplished by placing the pins for the top and bottom portions at appropriate angles with respect to the vertical in the mold for the bladder. As with all of the columns heretofore described, the relative lengths of the top and bottom portions can be altered to further tune the compressive response. Of course depending upon the particular geometry of a bladder, a column which is appointed to slant in the opposite direction may be used when no bias direction is desired. Such a column is depicted in broken lines in FIG. 13.

Figure 14:
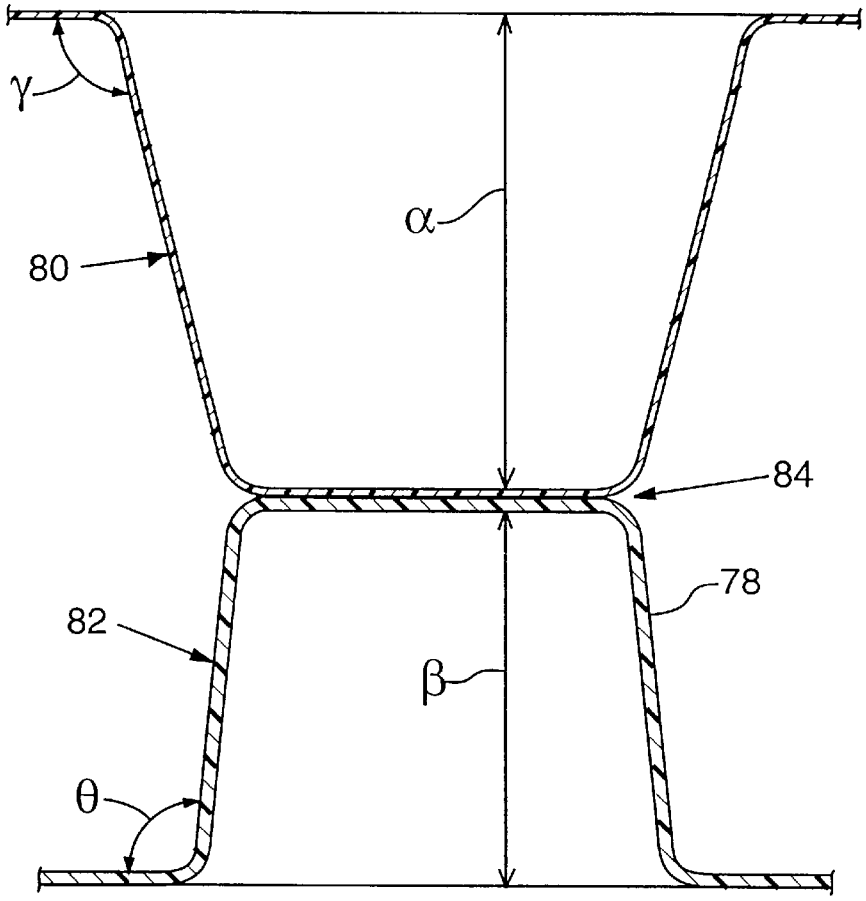
FIG. 14 is a detailed elevational view of a column tensile member in accordance with another preferred embodiment of the present invention, shown in an unloaded state.
Figure 15:
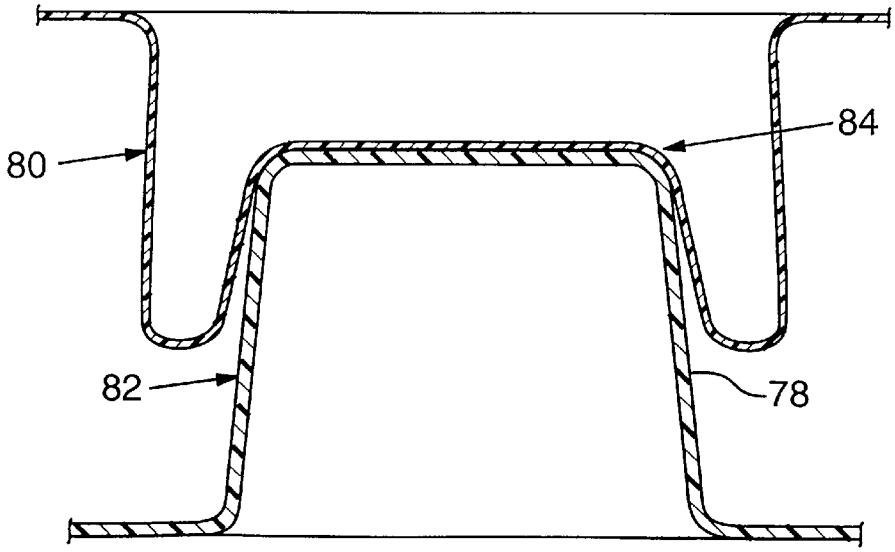
FIG. 15 is a detailed elevational view of the tensile member of FIG. 14 shown in a loaded state.

Yet another preferred embodiment of a controlled flex tensile member, column 78, is depicted in FIGS. 14 and 15 in the unloaded and loaded conditions respectively. The flex point is manipulated in this embodiment by altering the diameters of the pins or rod-like protrusions in the mold for the bladder, such that, as seen in FIG. 14, top portion 80 has a greater diameter than bottom portion 82. A junction 84 is defined between the two. This produces a column having one half wider than the other half so that upon compressive loading, the narrower portion of the column telescopes into the wider portion relative to the junction instead of the junction acting as a simple hinge. FIG. 15 illustrates column 78 in a loaded condition with bottom portion 82 telescoped into top portion 80 with respect to junction 84. Of course the wider portion may be provided as the bottom portion of the column as well.

In this particular embodiment, the top and bottom portions are formed with a number of differences to enable telescoping flexion: (i) the length of top portion 80, labeled as $\alpha$, is longer than the length of bottom portion 82, labeled as $\beta$; (ii) the top draft angle, labeled as $\delta$, is greater than the bottom draft angle, labeled as $\phi$; and (iii) the barrier perimeter thickness is 3 mm in all locations except the portions that make up top portion 80 where the thickness is 2 mm. All of these variations in the parameters enable the bottom portion to telescope into the top portion more easily. As seen in FIG. 15, the thinner wall thickness of top portion 80 enables it to more easily deform upon compression. In addition, the shorter length of bottom portion 82 makes it more resistant to deformation, so it is the portion that remains relatively undeformed and telescopes into a deformable portion of the column. The same can be said of the differences in the draft angles, that an increased draft angle makes that portion of the column more readily collapsible. All of these slight differences add up to customize the column and its behavior upon compressive load, and these parameters can all be adjusted to obtain the desired cushioning characteristics.

Figure 16:
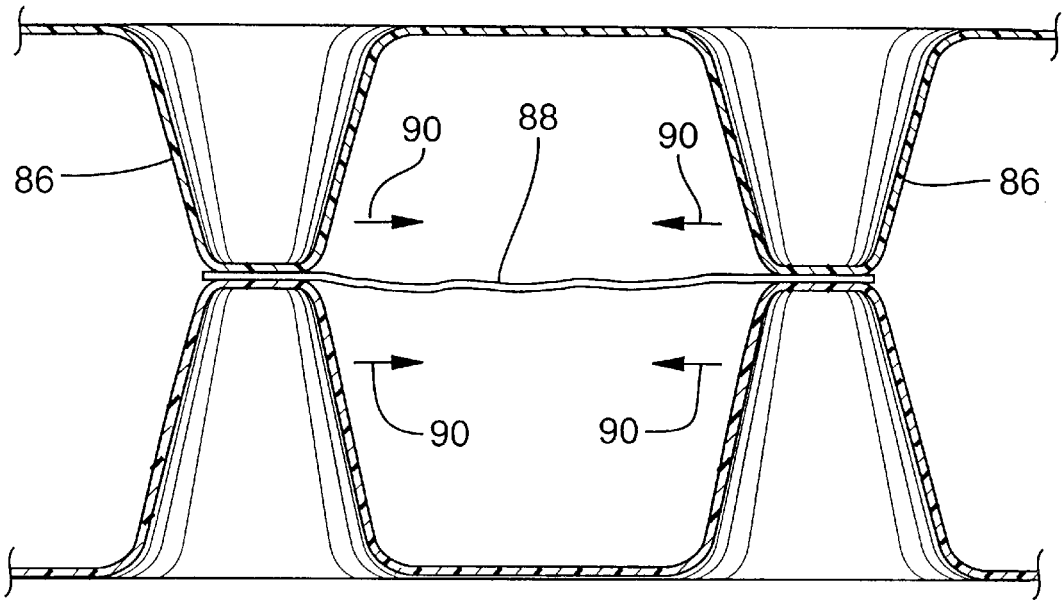
FIG. 16 is a detailed elevational view of a tensile member in accordance with another preferred embodiment of the present invention, shown in an unloaded state.

FIG. 16 illustrates a variation of the invention in which tensile members are tied together horizontally to further control the direction of flexion of the columns. This preferred embodiment of a tensile member has columns 86 tied together by spring elements 88 such as thin strips of thermoplastic urethane. The strips may be insert-molded during the blow-molding process so that spring element 88 preferably spans the gap between adjacent columns 86 formed by pins or rod-like protrusions located in the same half of the mold for the bladder. The adjacent columns 86 that are tied together horizontally in this manner will tend to flex most easily toward one another and spring element 88 as indicated by arrows 90. This is because spring element 88 would prevent the columns from flexing away from one another due to the resultant tensioning of the spring element. Of course, spring elements such as element 88 may be used with any tensile member configuration where control of the direction of flexion is desired. This may be particularly advantageous near the periphery of a bladder, or in combination with other tensile members which also tend to flex in a specified direction.

Figure 17:
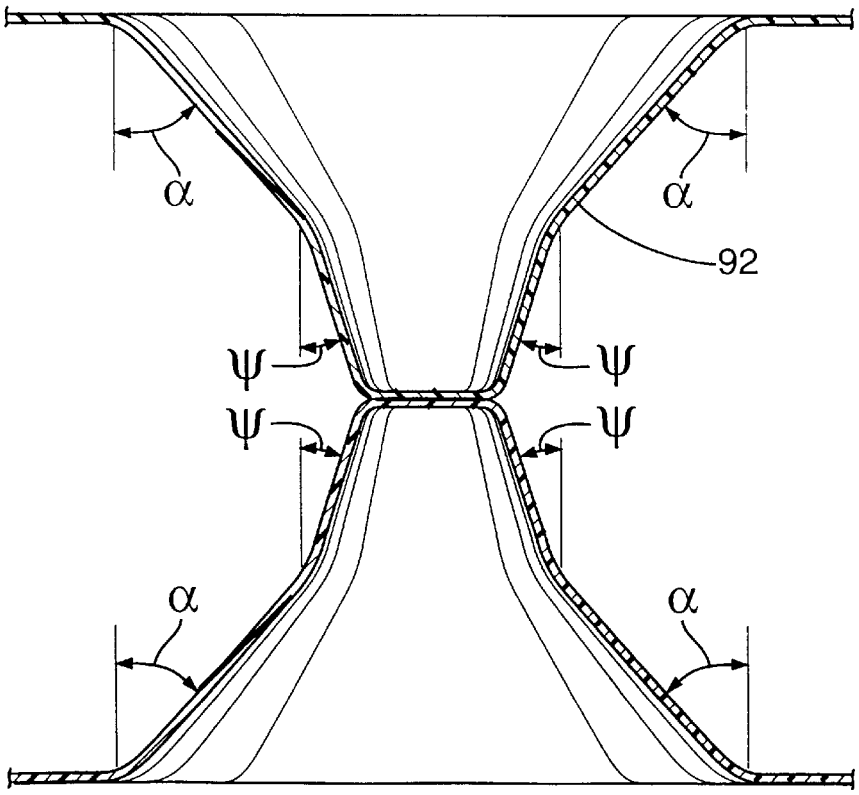
FIG. 17 a detailed elevational view of tensile member in accordance with another preferred embodiment of the present invention, shown in an unloaded state.
Figure 18:
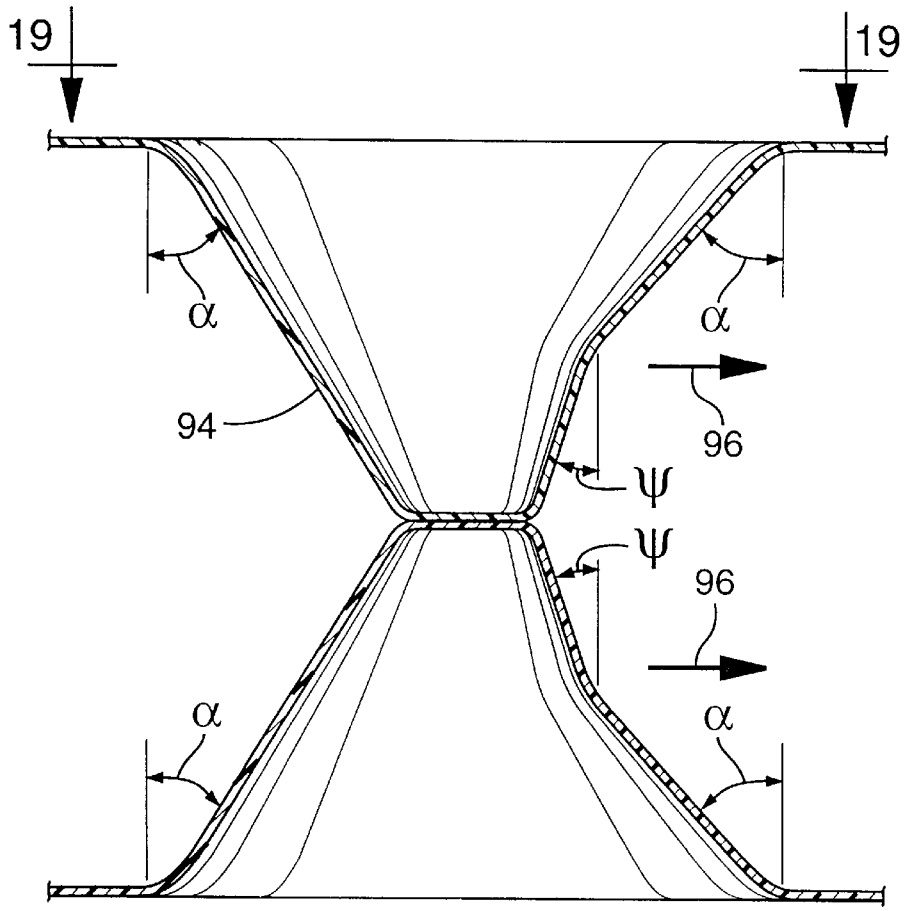
FIG. 18 is a detailed elevational view of a tensile member in accordance with another preferred embodiment of the present invention, shown in an unloaded state.
Figure 19:
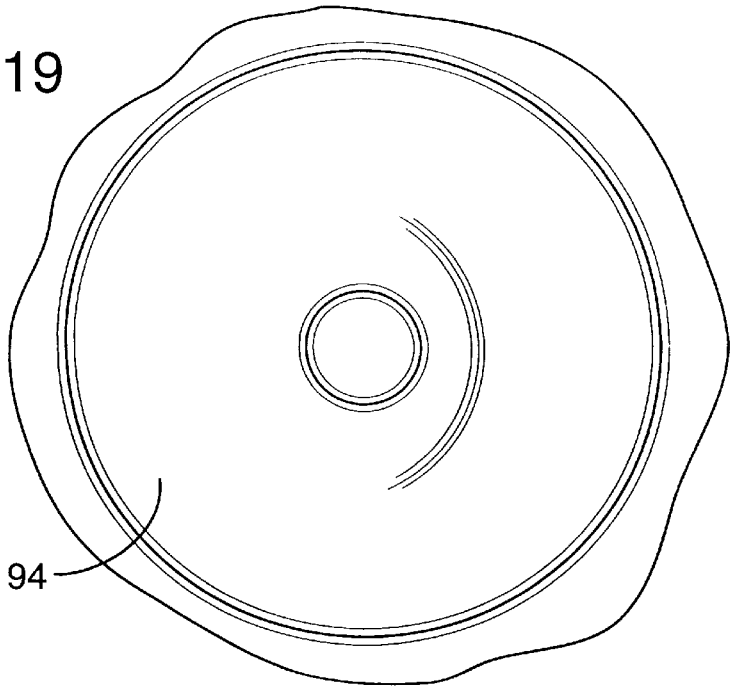
FIG. 19 is a top plan view of the tensile member illustrated in FIG. 18.

FIGS. 17, 18, and 19 illustrate further preferred embodiments of the invention in which the draft angles of a column are varied by adjusting the draft angles of the pins or rod-like protrusions in the mold for the bladder when forming the columns. In general, a draft angle of between 5° and 45° is needed in order to cause a column to flex in a predictable manner. The draft angle at the base of the pins or rod-like protrusions which form the columns can also effect the flex properties. The base of the pins or rod-like protrusions form the base of the tensile columns, and is the portion closest to the top and bottom surfaces of barrier layer of the bladder. Therefore, increasing or decreasing the draft angle at the base of the pins increases or decreases the wall thickness at the base of the column, thus effecting where and under what load the column will flex. The preferred draft angle range for the base of a column is 5° to 20°.

Specifically, FIG. 17 illustrates a preferred embodiment of the present invention in which a column 92 is depicted in an unloaded condition. The draft angle at the base of the column is labeled $\sigma$, and the draft angle of the mid-portion of the column is labeled $\psi$. In this particular embodiment angle a is preferably 7° and angle $\psi$ is preferably 5°. The "elbows" formed by draft angles $\sigma$ and $\psi$ would tend to flex in response to a compressive load thereby controlling the placement of the flexion and preventing unexpected buckling or bending elsewhere along the column.

FIGS. 18 and 19 illustrate another preferred embodiment of the present invention in which a column 94 is formed with draft angles which tend to direct flexion in a specific direction. The base of column 94 is circular, as seen in FIG. 19. Base draft angles $\sigma$ are provided on both sides of the column, but mid-portion draft angles $\psi$ are only provided on one side of the column. In response to a compressive load, column 94 would tend to flex in the direction of arrows 96 since the "elbows" formed by mid-portion angles $\psi$ would tend to flex more easily. In this particular embodiment angle $\sigma$ is preferably 7° and angle $\psi$ is preferably 5°. Thus, the direction of flexion as well as the location is controlled.

In the manner described herein, it is possible to finely tune the cushioning properties of the air bladder, and it is also possible to tune the flex properties of each individual column to match the impact requirements and anticipated sheer loads for a specific portion of the air bladder. Different athletic activities would benefit from air bladders designed to flex and sheer in manners that enhance the natural movements of the athlete performing the activity. For example, less flexible tensile members on the medial side of an air bladder used in a running shoe would provide increased resistance to compression and thus contribute to a reduced rate of pronation. Another example would be for activities that require quick cutting movements such as basketball and tennis. It may be beneficial to have the tensile members exhibit increased flexibility when loaded during a lateral cutting motion if it is shown that the tensile members experience fatigue failures due to the high loading conditions in these portions of the air bladder. Of course, other means would then need to be employed to increase the stability in these areas.

Figure 20A:
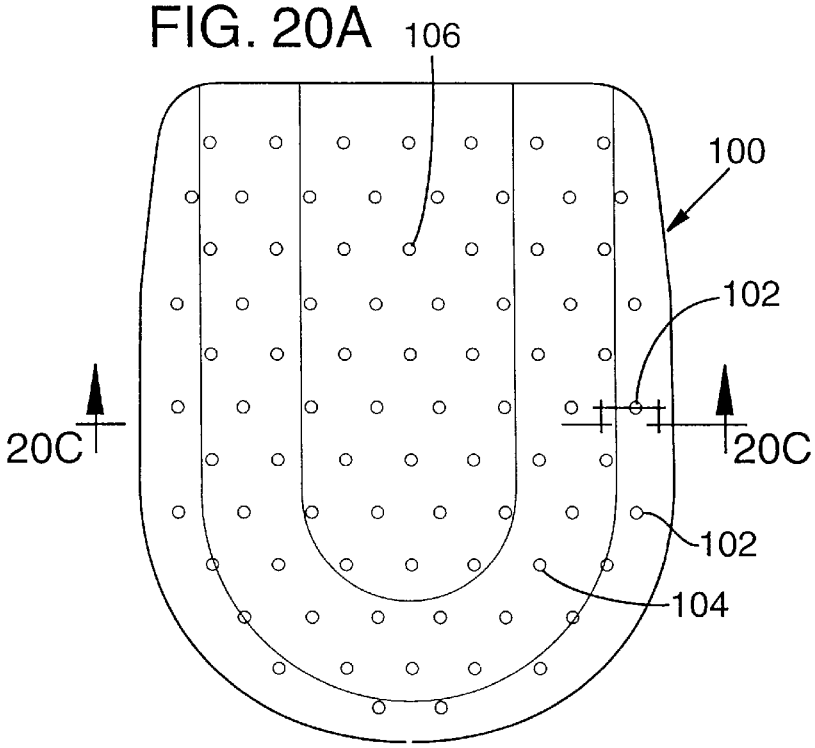
FIG. 20A is a top plan view of a bladder with pillar shaped controlled flex members in accordance with the present invention.
Figure 20B:
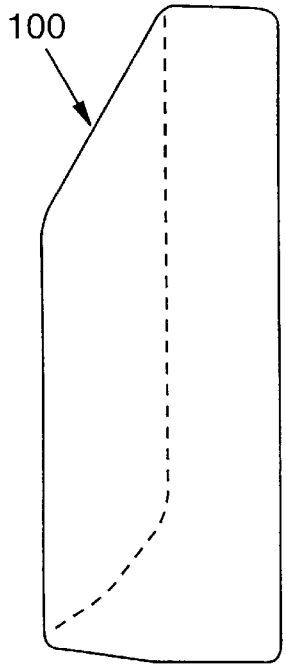
FIG. 20B is a side elevational view of the bladder of FIG. 20A.
Figure 20C:
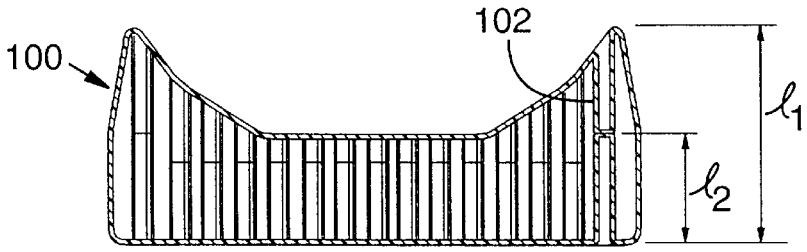
FIG. 20C is cross section of the bladder taken along line 20C—20C in FIG. 20A.

FIGS. 20A–20C illustrate a heel bladder 100 having tensile members 102 which are formed in the side peripheral areas of greatest height, and other tensile members 104, 106 in the transition areas and central area. As can be seen in FIGS. 20B and 20C, bladder 100 forms a tapered well for a heel with raised side and rear peripheral edges. The tallest areas have a height labeled $l_1$ in FIG. 20C and the lowest areas such as the central region have a height labeled $l_2$. Tensile members formed in the raised edges, columns 102, and in the transition areas, columns 104, in which the top barrier layer slopes downward into the lower central region, are taller than the tensile members, columns 106. The sloping and contouring are best seen in FIGS. 20B and 20C. Tensile member 102 of total length $l_1$ is shown in cross-section in FIG. 19C, and it can be seen that the top and bottom portions are of unequal length. The shortest columns 106 will be of length $l_2$. All of the columns of bladder 100 are of equal diameter, and the combination of these columns lend bladder 100 its contoured shape. The contoured shape of bladder 100 allows it to be inserted into a sole assembly of a shoe without encasing it in foam. Eliminating as much foam as possible from the sole assembly eliminates interference with the cushioning properties of air.

Figure 21A:
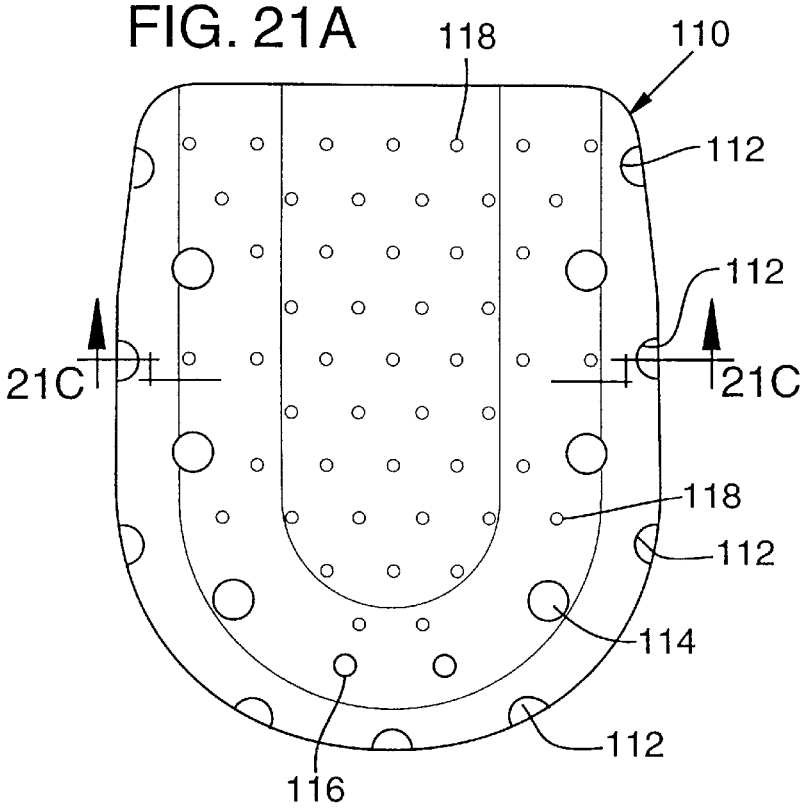
FIG. 21A is a top plan view of another bladder with pillar shaped controlled flex members in accordance with the present invention.
Figure 21B:
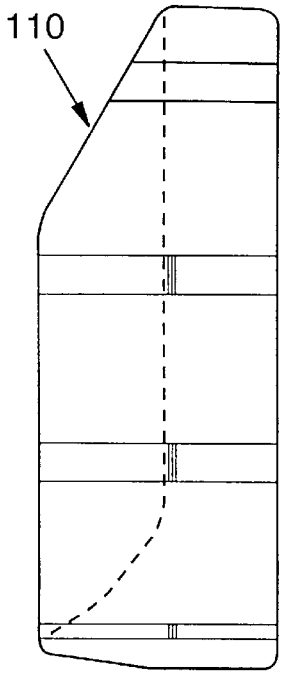
FIG. 21B is a side elevational view of the bladder of FIG. 21A.
Figure 21C:
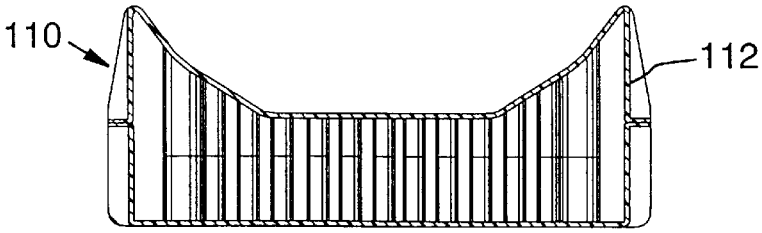
FIG. 21C is a cross section of the bladder taken along line 21C—21C of FIG. 21A.

FIGS. 21A–21C illustrate another embodiment of a contoured, tapered heel bladder 110 having formed therein partial columns or pillars 112. Then, immediately inside of the partial pillars are large pillars 114 which are of relatively large diameter extending along the sides, and intermediate pillars 116 which are of a smaller diameter in the rear portion of the bladder. The central portion of bladder 110 has formed therein a multitude of thin pillars 118 which are least resistant to compression. Since bladder 110 is tapered, partial pillars 112 are placed in the periphery and therefore are the tallest. Large pillars 114 and intermediate pillars 116 are in the transition area where the top of the bladder slopes downward. Thin pillars 118 are in the central area and are the shortest. Using larger diameter pillars in the peripheral areas provides "stiffer" cushioning characteristics to the edges.

Figure 22:
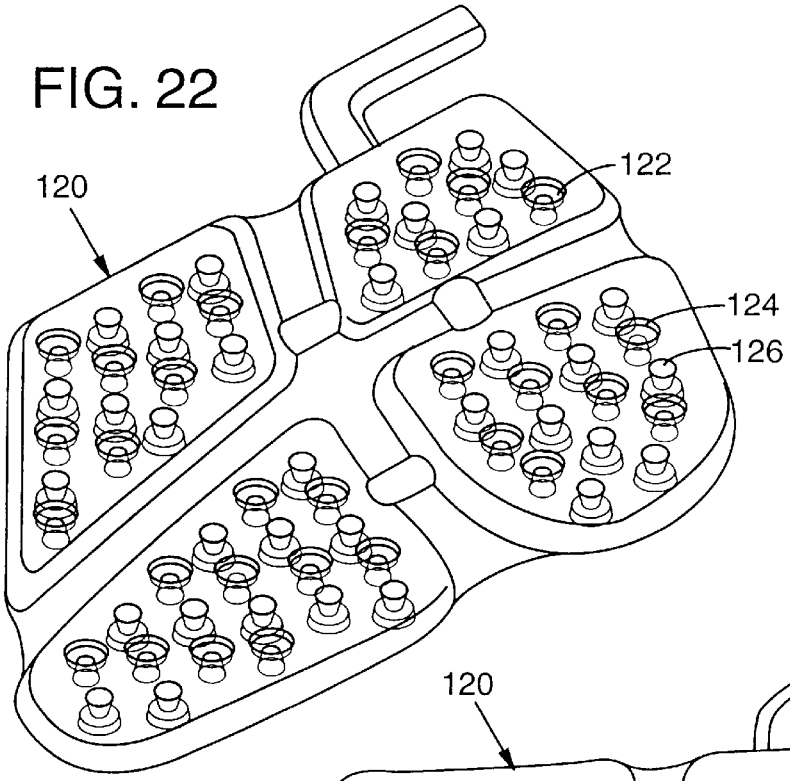
FIG. 22 is a perspective view of a bladder with drumhead shaped controlled flex members in accordance with the present invention.
Figure 23:
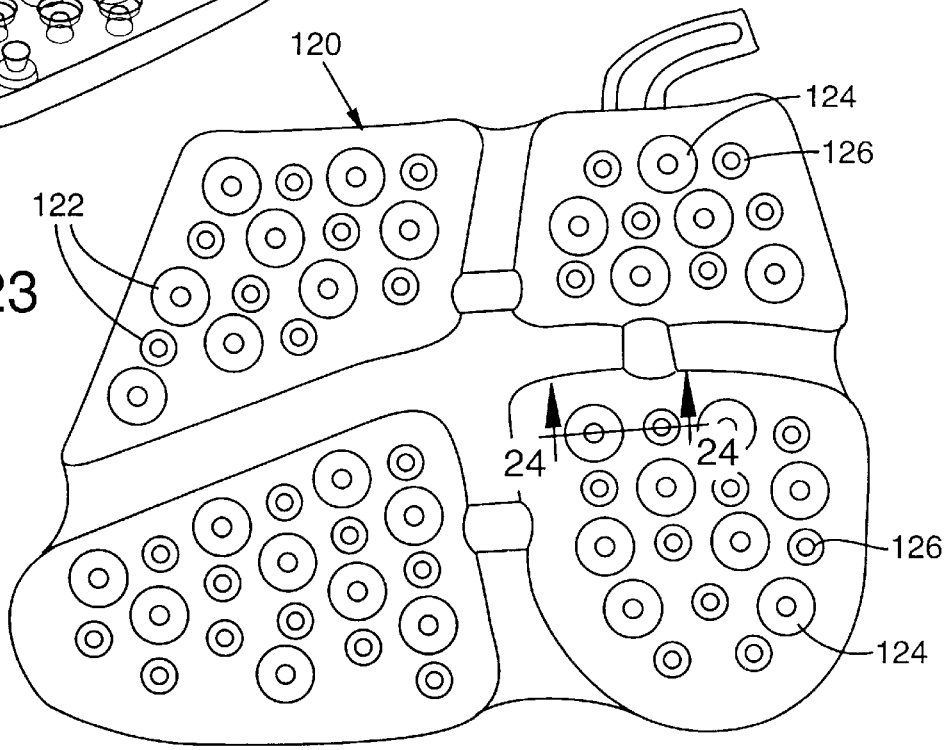
FIG. 23 is a top plan view of the bladder of FIG. 22.
Figure 24:
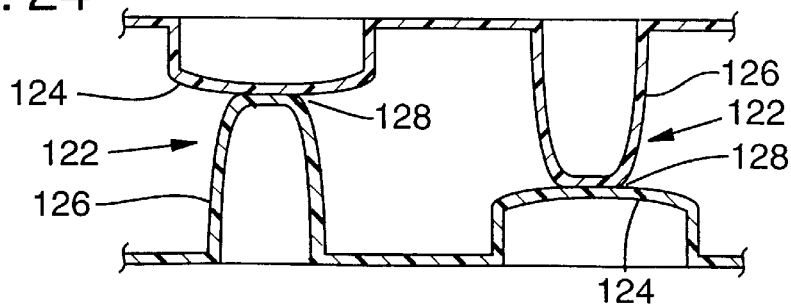
FIG. 24 is a detailed cross section taken through line 24—24 of FIG. 23.

FIGS. 22–24 illustrate another preferred embodiment in which a bladder 120 is provided with drumhead tensile members or pillars 122. Each drumhead pillar 122 comprises a larger diameter portion 124 and a smaller diameter portion 126 in vertical and axial alignment with one another and joined at interface or juncture 128. These pillars are called drumhead pillars due to the similarity in shape of larger diameter portion 124 to a drum. In this particular bladder, the pillars are arranged in alternating fashion so that adjacent pillars are in inverted relation to one another. From either side of the bladder, larger diameter portions 124 alternate with smaller diameter portions 126. Smaller diameter portion 126 is designed to collapse into larger diameter portion 124 upon full compressive loading. As can be seen in FIG. 24, larger diameter portions 124 are designed to have a curvature onto which is joined smaller diameter portions 126. This interface 128 allows for the smaller diameter portions to flex by rolling slightly with respect to the drumhead or larger diameter portions when the bladder is compressed slightly. To enable the smaller diameter portion of the pillar to collapse into the drumhead, compressive loading must be sufficient to overcome the curvature of the drumhead. As a result, this type of controlled flex tensile member provides a relatively stiff response to compressive loading.

Figure 25:
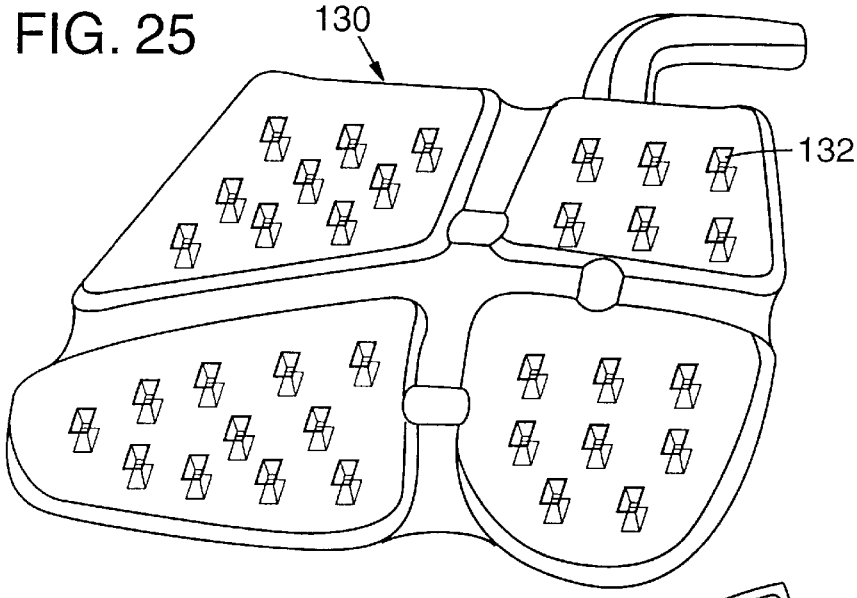
FIG. 25 is a perspective view of a bladder with notched pillar controlled flex members in accordance with the present invention.
Figure 26:
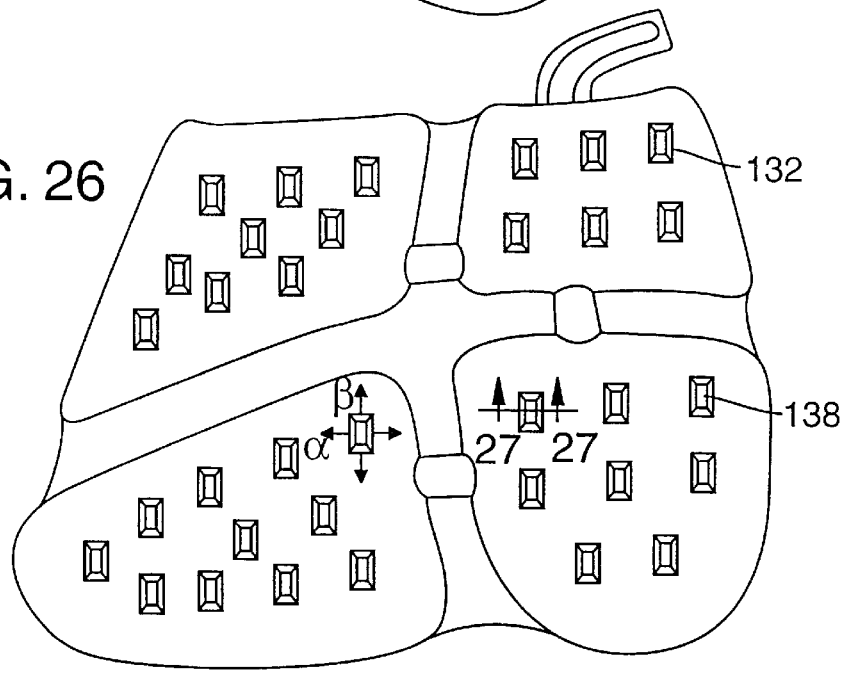
FIG. 26 is a top plan view of the bladder of FIG. 25.
Figure 27:
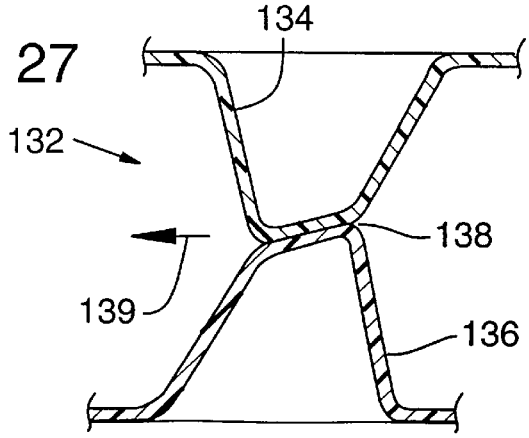
FIG. 27 is a detailed cross section taken through line 27—27 of FIG. 26.

FIGS. 25–27 illustrate another preferred embodiment in which a bladder 130 is provided with notched tensile members or pillars 132. Each notched pillar 132 comprises opposed portions having trapezoidal cross sections 134 and 136 joined at a junction 138, with notches formed at the junctures of the sides of the trapezoid. The junction 138 has a minor axis, labeled $\alpha$ in FIG. 26, and a major axis, labeled $\beta$. The surface area of the junction will be a factor in determining the controlled flex direction of the pillar. Unless the surface area is a perfect square, a notched pillar will tend to flex in a direction parallel to the minor axis $\alpha$. Of course since the direction is flexion is preferably controlled, the surface area of the juncture of notched pillar portions should generally be rectangular to take advantage of this material property. As seen in FIG. 27, notched pillars 132 will tend to flex in the direction of arrow 139 upon compressive loading of the bladder. Notched pillars provide a relatively stiff response to a compressive load similar to drumhead pillars.

Figure 28:
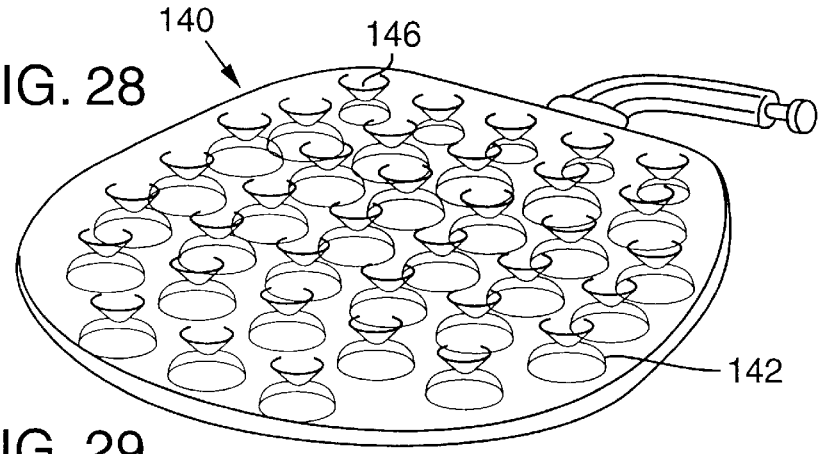
FIG. 28 is a perspective view of a first side of a bladder with chalice shaped controlled flex members in accordance with the present invention.
Figure 29:
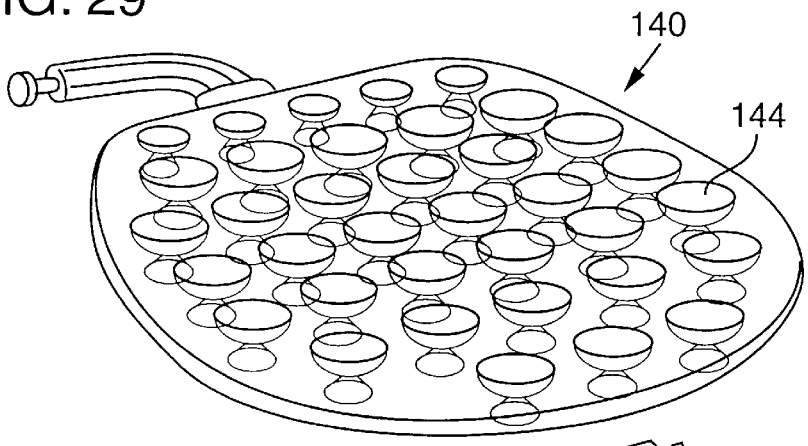
FIG. 29 is a perspective view of a second side of the bladder of FIG. 28.
Figure 30:
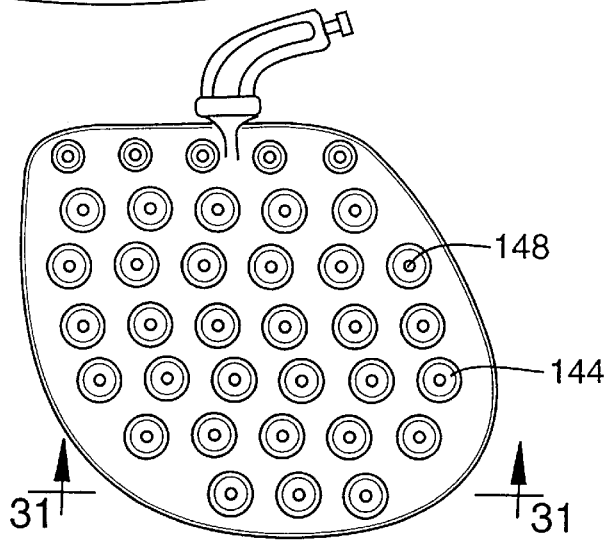
FIG. 30 is a plan view of the second side of the bladder of FIG. 28.

FIGS. 28–36 illustrate yet another preferred embodiment in which a bladder 140 is provided with collapsible tensile members 142. These tensile members, in cross section, have a shape that is reminiscent of a chalice shape, and are referred to as chalice shaped tensile members. Each chalice shaped tensile member is comprised of a cup portion 144 opening to one side of the bladder, and a base portion 146 opening to the opposite side of the bladder. FIGS. 28 and 29 illustrate the two sides of bladder 140, FIG. 28 showing the side with the bases up, and FIG. 29 showing the side with the cups up. As best seen in FIG. 30, junctions 148 between cup portions 144 and base portions 146 are circular. The cross sections of FIGS. 31–36 are schematic and do not fully illustrate that interface which actually has a slight depression in the underside of the cup portion where the base portion is attached. This ensures that upon compressive loading, there is no rolling of the portions with respect to one another, but that tensile member 142 collapses as it is designed to collapse.

Figure 31:
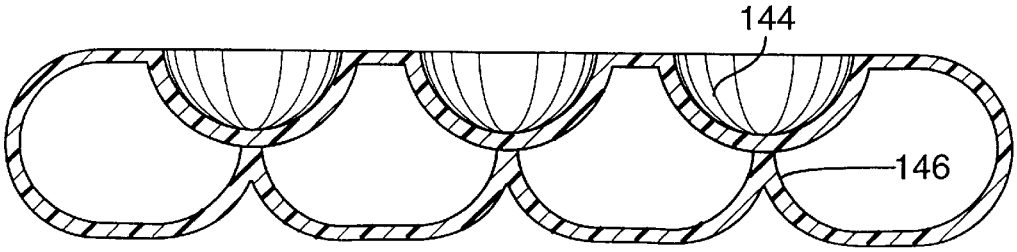
FIG. 31 is a cross section of the bladder taken through line 31—31 of FIG. 30.
Figure 32:
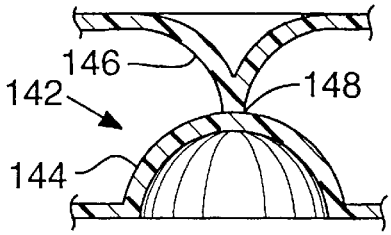
FIG. 32 is a schematic cross section of a chalice shaped controlled flex member shown in an unloaded state.
Figure 33:
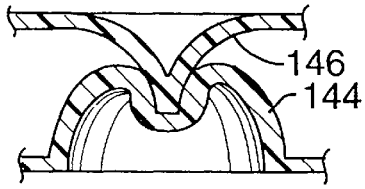
FIG. 33 is a schematic cross section of the controlled flex member of FIG. 32 shown during compressive loading.
Figure 34:
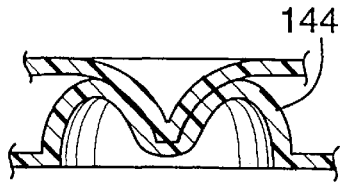
FIG. 34 is a schematic cross section of the controlled flex member of FIGS. 32 and 33 shown in the fully loaded state.

Tensile members 142 are designed to collapse into one another by base portion 146 collapsing into the bottom of cup portion 144. FIG. 31 is shown with the cup portions facing upward to illustrate the shapes of the tensile members. In a sole assembly of a shoe, however, the cup portion would generally be facing downward toward the ground or ground engaging element. FIGS. 32–34 illustrate schematically a tensile member 142 in the unloaded state, during load and upon full compressive load respectively. Base portion 146 pushes into cup portion 144 providing predetermined collapse of the tensile member. In general, tensile members 142 provide a relatively soft response to a compressive load and are suitable for a strike area.

Figure 35:
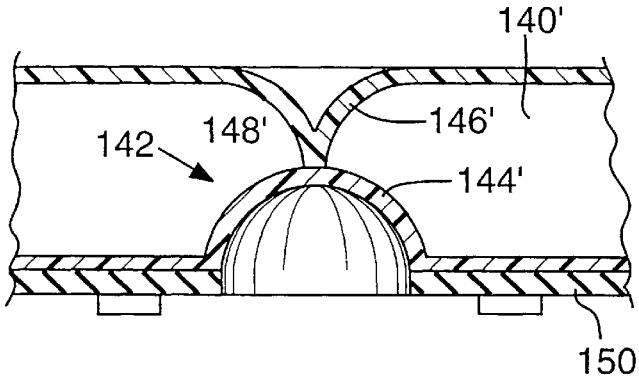
FIG. 35 is a schematic cross section of a chalice shaped controlled flex member of a bladder mounted in a sole assembly shown in an unloaded state.
Figure 36:
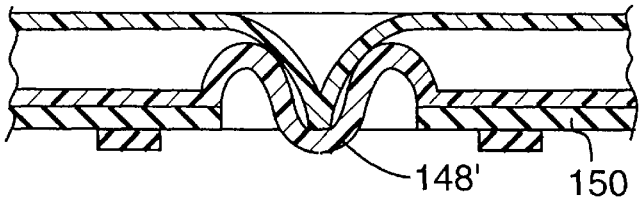
FIG. 36 is a schematic cross section of a chalice shaped controlled flex member of a bladder mounted in a sole assembly shown in a loaded state.

In an alternative configuration, a bladder 140' with tensile members 142' can be used with an outsole with openings that allow the collapsed underside of the tensile members to extend downward, even beyond the outsole and engage the ground. FIGS. 35 and 36 illustrate such a configuration schematically in the unloaded and fully loaded conditions respectively. Outsole 150 is attached to bladder 140' and is adapted to engage the ground. Outsole 150 has perforations or other openings so that cup portion 144' opens to the ground. When bladder 140' is compressively loaded, base portion 146' collapses into cup portion 144', and the point of juncture 148' extends beyond the outsole 150 and engages the ground. This configuration may be especially suitable for enhancing the traction of footwear designed for soft surfaces such as grass, clay or dirt. Also, since it would take a full compressive load for the point to extend through the outsole and contact the ground, this type of tensile member and outsole combination is likely most useful for strike areas of the foot such as the heel area or under the ball of the foot. In other words, areas where a fill compressive load occurs frequently.

Figure 37:
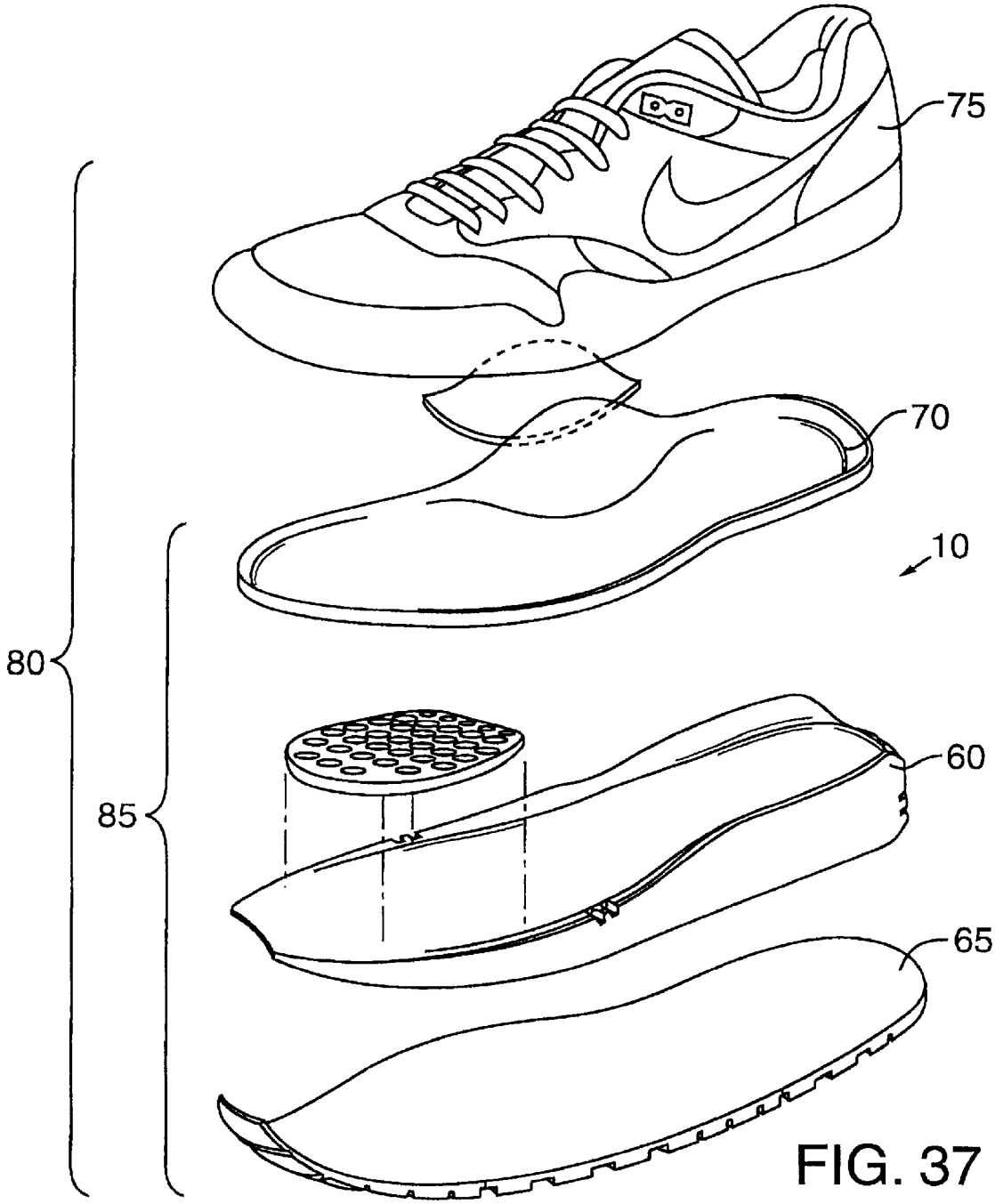
FIG. 37 is an exploded perspective view of an article of footwear incorporating the bladder of FIG.28.

A bladder 140 is illustrated in FIG. 37 as part of a midsole assembly for a shoe S. The shoe comprises an upper U, an insole I, a midsole assembly M, and an outsole O. Bladder 140 can be incorporated into midsole 175 by any conventional technique such as foam encapsulation or placement in a cut-out portion of a foam midsole. A suitable foam encapsulation technique is disclosed in U.S. Pat. No. 4,219,945 to Rudy, hereby incorporated by reference.

In the embodiments disclosed herein, the juncture between the two portions making up the tensile member is formed during the molding process for the bladder so that there would be actual fusion of material at the juncture. The two portions of the tensile members are drawn separately and shown with a boundary for illustrative purposes.

From the foregoing detailed description, it will be evident that there are a number of changes, adaptations, and modifications of the present invention which come within the province of those skilled in the art. However, it is intended that all such variations not departing from the spirit of the invention be considered as within the scope thereof as limited solely by the claims appended hereto.

What is claimed is:

1. A sealed gas-filled bladder for a footwear sole comprising:

a top barrier layer having a top major surface and a perimeter;

a bottom layer having a bottom major surface and a perimeter;

said respective perimeters of said top and bottom layers being joined to one another to form a sealed chamber, said sealed chamber containing a gas;

a top columnar-shaped indentation extending into said sealed chamber from said top major surface, said top columnar-shaped indentation having a linear sidewall portion;

a bottom columnar-shaped indentation extending into said sealed chamber from said bottom member;

said top and bottom columnar-shaped indentations having closed ends joined to one another at a juncture within said sealed chamber;

said top and bottom columnar-shaped indentations having a structure extending from said joined closed ends forming a flex point at said respective junctures that tends to buckle said columnar-shaped indentations at said juncture in response to a compressive load moving said top and bottom major surfaces toward one another, said structure defining a notch extending underneath said linear sidewall portion.

2. The bladder of claim 1, wherein said structure comprises a first portion of said top columnar-shaped indentation joined to a second portion of said top columnar-shaped indentation so that said first portion collapses into said second portion upon compressive loading and recovers to its resting state upon removal of a compressive load.

3. The bladder of claim 2, wherein said flex point is formed at a juncture of said first portion and said second portion.

4. The bladder of claim 1, wherein said top and bottom columnar-shaped indentations have circular cross-sections.

5. The bladder of claim 4, wherein at least a portion of said top columnar-shaped indentation is angled relative to a vertical axis to preferentially direct bending about said juncture upon compressive loading.

6. The bladder of claim 5, wherein said top columnar-shaped indentation is angled along substantially its entire length relative to a vertical axis.

7. The bladder of claim 4, wherein said top and bottom columnar-shaped indentations are comprised of opposed frustoconical pillars joined at their small ends.

8. The bladder of claim 7, wherein two adjacent said top columnar-shaped indentations are tied together by a webbing extending therebetween and attached at said juncture to direct bending of said top columnar-shaped indentations toward each other upon compressive loading.

9. The bladder of claim 7, wherein said frustoconical columnar structure comprises at least one wall with an intermediate bend to provide an additional flex point upon compressive loading.

10. The bladder of claim 1, wherein said top and bottom columnar-shaped indentations have a polygonal cross-section.

11. The bladder of claim 1, wherein said juncture is angled with respect to the horizontal to predispose said top columnar-shaped indentation to bend in a predicted direction upon compressive loading.

12. The bladder of claim 1, wherein said gas contained in said bladder places said top and bottom columnar-shaped indentations under tension.

13. The bladder of claim 12, wherein said gas is above atmospheric pressure.

14. The bladder of claim 12 in combination with an article of footwear comprised of an upper and a sole including a cushioning midsole, wherein said bladder is supported in said midsole.

15. A sealed gas-filled bladder for a footwear sole comprising:

a top barrier layer having a top major surface and a perimeter;

a bottom layer having a bottom major surface and a perimeter;

said respective perimeters of said top and bottom layers being joined to one another to form a sealed chamber, said sealed chamber containing a gas;

a plurality of top columnar-shaped indentations extending into said sealed chamber from said top major surface, said columnar-shaped indentations having linear sidewall portions;

a plurality of bottom columnar-shaped indentations extending into said sealed chamber from said bottom member, said columnar-shaped indentations having linear sidewall portions;

said top and bottom columnar-shaped indentations having closed ends joined to one another at a juncture within said sealed chamber;

said top and bottom columnar-shaped indentations having a structure extending from said joined closed ends forming a flex point at said respective junctures that tends to buckle said columnar-shaped indentations at said juncture in response to a compressive load moving said top and bottom major surfaces toward one another, said structure forming a notch extending inward of said top and bottom linear sidewall portions of joined indentations.

16. The bladder of claim 15, wherein at least a portion of said top or bottom indentations is angled relative to a vertical axis to preferentially direct bending upon compressive loading.

17. The bladder of claim 16, wherein said top and bottom indentations are entirely angled relative to a vertical axis.

18. The bladder of claim 15, wherein said top and bottom indentations are comprised of opposed frustoconical pillars joined at their small diameter ends.

19. The bladder of claim 18, wherein two adjacent pairs of joined top and bottom indentations are tied together by a webbing extending therebetween and attached at said juncture to direct bending of said flexible tensile members toward each other upon compressive loading.

20. The bladder of claim 18, wherein said frustoconical pillars comprise at least one wall with an intermediate bend to provide an additional point of flex upon compressive loading.

21. The bladder of claim 15 in combination with an article of footwear comprised of an upper and a sole connected to said upper, said sole including a cushioning midsole, wherein said bladder is supported in said midsole.

* * * * *